US008316673B2

(12) United States Patent
Lee et al.

(10) Patent No.: US 8,316,673 B2
(45) Date of Patent: Nov. 27, 2012

(54) APPARATUS OF SUPPLYING AND DISCHARGING FLUID AND METHOD OF OPERATING THE SAME

(75) Inventors: Sung Hwan Lee, Changwon-si (KR); Ok Chun Hyun, Busan (KR)

(73) Assignee: LG Electronics Inc., Seoul (KR)

( * ) Notice: Subject to any disclaimer, the term of this patent is extended or adjusted under 35 U.S.C. 154(b) by 828 days.

(21) Appl. No.: 12/084,975

(22) PCT Filed: Nov. 15, 2006

(86) PCT No.: PCT/KR2006/004817

§ 371 (c)(1),
(2), (4) Date: Jun. 19, 2009

(87) PCT Pub. No.: WO2007/058477

PCT Pub. Date: May 24, 2007

(65) Prior Publication Data

US 2009/0320213 A1 Dec. 31, 2009

(30) Foreign Application Priority Data

| | | |
|---|---|---|
| Nov. 15, 2005 | (KR) | 10-2005-0109355 |
| Nov. 23, 2005 | (KR) | 10-2005-0112609 |
| Nov. 23, 2005 | (KR) | 10-2005-0112610 |
| Nov. 23, 2005 | (KR) | 10-2005-0112611 |
| Nov. 23, 2005 | (KR) | 10-2005-0112612 |
| Nov. 23, 2005 | (KR) | 10-2005-0112614 |

(51) Int. Cl.
*B08B 3/12* (2006.01)
*D06F 37/00* (2006.01)

(52) U.S. Cl. ..... 68/3 R

(58) Field of Classification Search ..... 68/3 R
See application file for complete search history.

(56) References Cited

U.S. PATENT DOCUMENTS

| | | | | |
|---|---|---|---|---|
| 5,337,500 | A * | 8/1994 | Enokizono | 34/77 |
| 6,591,439 | B2 * | 7/2003 | Whah et al. | 8/159 |
| 6,756,066 | B2 * | 6/2004 | Jeong et al. | 426/46 |
| 2004/0103925 | A1 * | 6/2004 | Marettek | 134/56 D |
| 2004/0187527 | A1 * | 9/2004 | Kim et al. | 68/5 C |
| 2005/0238631 | A1 | 10/2005 | Burwell | |

FOREIGN PATENT DOCUMENTS

| | | | |
|---|---|---|---|
| CN | 1684976 | A | 10/2005 |
| EP | 1 302 108 | A2 | 4/2003 |
| WO | WO 2004/099308 | | 11/2004 |

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

The present invention relates to n apparatus of supplying and discharging a fluid, comprising: an inner tub; a fluid inflow passage connected to the inner tub; and a fluid outflow passage connected to the inner tub, wherein at least one of the inner tub, the inflow passage and the outflow passage has undergone at least one of the Kimchi lactic acid bacteria culture treatment and the Kimchi lactic acid bacteria culture exposure treatment.

23 Claims, 10 Drawing Sheets

APPARATUS OF SUPPLYING AND DISCHARGING FLUID AND METHOD OF OPERATING THE SAME

TECHNICAL FIELD

The present invention relates to an apparatus of supplying and discharging a fluid, especially, a washing machine, a drying machine and a dishwashing machine, and more particularly, to a washing machine, a drying machine and a dishwashing machine which have undergone the Kimchi lactic acid bacteria culture treatment (coating of the Kimchi lactic acid bacteria culture, etc.) and/or the Kimchi lactic acid bacteria culture exposure treatment (installation of a filter containing the Kimchi lactic acid bacteria culture, etc.).

BACKGROUND ART

Recently, with a growing interest in the hygiene and cleanliness, a number of products have been developed to improve the hygiene and cleanliness. The electronic product field is not an exception. In detail, electric home appliances needing the hygiene and cleanliness include a refrigerator, washing machine, drying machine, air conditioner, air freshener, fan, cleaner, electric pot, electric cooker, dishwashing machine, dish drying machine, microwave oven, mixer, VTR, television, home theater, etc.

Bacteria or molds which can be parasitic on the surfaces of the products or the surfaces of the components of the products cause diseases such as atopic dermatitis, respiratory trouble, etc., disfigure the products, generate a bad smell, and discolor the external appearances of the products. It is therefore necessary to manufacture an antimicrobial article for protecting the users from the diseases and keeping the external appearances of the products, by preventing the contact and proliferation of various bacteria and molds.

Generally, most of antibacterial agents for manufacturing an antibacterial article are chemically synthesized, to require the high cost and cause harmful side effects. Recently, researches have been actively made on a natural antibacterial material which has an excellent antibacterial property and removes side effects harmful for a human body.

Kimchi lactic acid bacteria are generated in fermentation and ripening of Kimchi. Safety of the Kimchi lactic acid bacteria with the natural origin has been verified by the long time use. It is easy to acquire the Kimchi lactic acid bacteria at a low cost. In addition, the Kimchi lactic acid bacteria have been known as a natural antibacterial material with an excellent antibacterial property and a wide antibacterial spectrum. Moreover, there has been reported that the Kimchi lactic acid bacteria culture fluid could restrict avian influenza, and activity of viruses with the similar mechanism to that of avian influenza viruses.

Accordingly, the present inventors have accomplished this invention by giving the antimicrobial property to a surface of an article by using the antibacterial and antivirus effects of the Kimchi lactic acid bacteria culture fluid.

DISCLOSURE OF INVENTION

Technical Problem

An object of the present invention is to provide an apparatus of supplying and discharging a fluid which has undergone the Kimchi lactic acid bacteria culture fluid treatment and/or the Kimchi lactic acid bacteria culture fluid exposure treatment with antibacterial and antivirus effects, and a method of operating the same.

Another object of the present invention is to provide a washing machine which has undergone the Kimchi lactic acid bacteria culture fluid treatment and/or the Kimchi lactic acid bacteria culture fluid exposure treatment with antibacterial and antivirus effects, and a method of operating the same.

Yet another object of the present invention is to provide a drying machine which has undergone the Kimchi lactic acid bacteria culture fluid treatment and/or the Kimchi lactic acid bacteria culture fluid exposure treatment with antibacterial and antivirus effects, and a method of operating the same.

Yet another object of the present invention is to provide a dishwashing machine which has undergone the Kimchi lactic acid bacteria culture fluid treatment and/or the Kimchi lactic acid bacteria culture fluid exposure treatment with antibacterial and antivirus effects, and a method of operating the same.

Technical Solution

In order to achieve the above-described objects of the invention, there are provided an apparatus of supplying and discharging a fluid, including: an inner tub; a fluid inflow passage connected to the inner tub; and a fluid outflow passage connected to the inner tub, wherein at least one of the inner tub, the inflow passage and the outflow passage has undergone at least one of a Kimchi lactic acid bacteria culture treatment and a Kimchi lactic acid bacteria culture exposure treatment, and a method of operating the same.

The Kimchi lactic acid bacteria culture treatment is performed by at least one of coating of the Kimchi lactic acid bacteria culture and molding of a material containing the Kimchi lactic acid bacteria culture.

The Kimchi lactic acid bacteria culture exposure treatment is performed by at least one of installation of a filter and supply of the Kimchi lactic acid bacteria culture.

The apparatus of supplying and discharging the fluid is one of a washing machine, a drying machine and a dishwashing machine.

The apparatus of supplying and discharging the fluid further includes a recirculation passage for circulating the fluid in the inner tub, wherein the recirculation passage has undergone at least one of the Kimchi lactic acid bacteria culture treatment and the Kimchi lactic acid bacteria culture exposure treatment.

The apparatus of supplying and discharging the fluid further includes a steam passage for supplying steam to the inner tub, wherein the steam passage has undergone at least one of the Kimchi lactic acid bacteria culture treatment and the Kimchi lactic acid bacteria culture exposure treatment.

The apparatus of supplying and discharging the fluid further includes a detergent box for supplying a detergent to the inner tub, wherein the detergent box has undergone at least one of the Kimchi lactic acid bacteria culture treatment and the Kimchi lactic acid bacteria culture exposure treatment.

The apparatus of supplying and discharging the fluid further includes a filter at an inlet of the outflow passage, wherein the filter has undergone the Kimchi lactic acid bacteria culture treatment.

Advantageous Effects

In accordance with the present invention, the apparatus of supplying and discharging the fluid and the method of operating the same can improve the antimicrobial property on the surfaces of the various articles needing the antimicrobial effect, by using the Kimchi lactic acid bacteria culture fluid with the wide antibacterial spectrum.

In addition, the apparatus of supplying and discharging the fluid and the method of operating the same can give the antivirus effect against avian influenza, and viruses with the similar mechanism to that of avian influenza viruses, by using the antivirus property of the Kimchi lactic acid bacteria culture fluid.

MODE FOR THE INVENTION

The present invention will now be described in detail with reference to the accompanying drawings.

Figure 1:
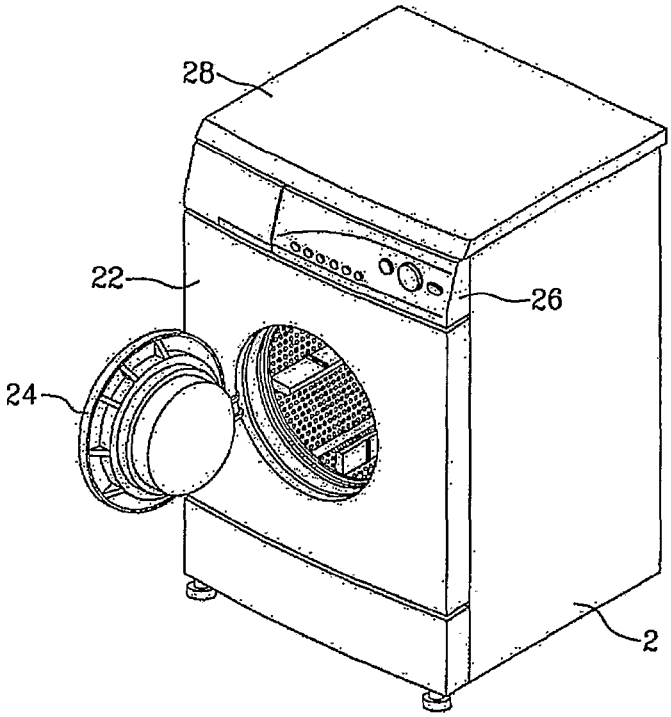
FIGS. 1 and 2 are structure views illustrating a drum type washing machine in accordance with the present invention.
Figure 2:
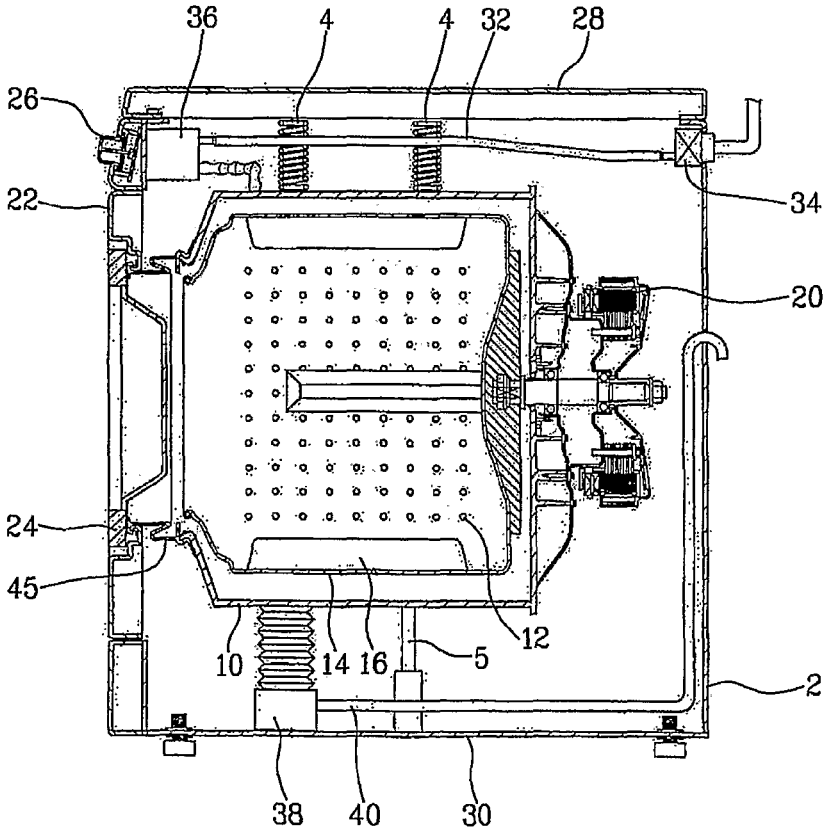

FIGS. 1 and 2 are structure views illustrating a drum type washing machine in accordance with the present invention. The drum type washing machine includes a cabinet 2 for forming the external appearance, a tub 10 installed inside the cabinet 2 with its upper portion hung by a spring 4 and its lower portion supported by a damper 5, a drum 14 being rotatably installed inside the tub 10, and having a plurality of through holes 12 for wash water or foam, lifts 16 installed on the inside surface of the drum 14, for lifting the laundry to a predetermined height and dropping the laundry to evenly mix the laundry, and a motor 20 installed at the rear portion of the tub 10, for rotating the drum 14.

A cabinet cover 22 having an inlet at its center portion so that the user can put the laundry into the washing machine or take the laundry cut of the washing machine is mounted on the front surface of the cabinet 2 as a part of the cabinet 2. A door 24 for preventing the laundry from coming cut of the inlet is installed on the front surface of the cabinet cover 22 to be opened and closed on the inlet. A control panel 26 for controlling driving of the washing machine is installed at the upper portion of the cabinet cover 22. A gasket 45 is installed between the cabinet cover 22 and the tub 10 for sealing up the gap between the door 24 and the tub 10.

A top plate 28 and a base 30 are mounted on the opened top and bottom surfaces of the cabinet 2 as a part of the cabinet 2. A water supply hose 32, a water supply valve 34 and a detergent box 36 for supplying wash water and detergent into the tub 10 are installed at the lower portion of the top plate 28. A drain pump 38 and a drain hose 40 for circulating or draining wash water are installed on the top surface of the base 30.

The present invention treats at least one of the gasket 45, the tub 10, the detergent box 36; the drum 14, the lifts 16, the door 24, the water supply hose 32, the water supply valve 34, the drain hose 40 and the drain pump 38 with the Kimchi lactic acid bacteria culture.

The Kimchi lactic acid bacteria culture treatment can be carried cut by coating the Kimchi lactic acid bacteria culture on the drum 14 and the likes, or molding the drum 14 and the likes with a material containing the Kimchi lactic acid bacteria culture.

The gasket 45 is pleated to seal up the gap between the tub 10 and the door 24 and absorb shock from the tub 10 and the door 24. The pleated portions of the gasket 45 may be contaminated with the residual wash water or detergent, and give cat a bad smell. The gasket 45 can be protected from such contamination by the Kimchi lactic acid bacteria culture treatment.

After washing, alien substances or detergent residues may be left in the tub 10. The remaining alien substances or detergent residues form the propagation environment for molds and bacteria. The tub 10 can be protected from such contamination by the Kimchi lactic acid bacteria culture treatment.

The detergent box 36 contains the detergent. The detergent is always coagulated and kept in the detergent box 36, so that molds and bacteria can propagate themselves in the detergent box 36. The detergent box 36 can be protected from such contamination by the Kimchi lactic acid bacteria culture treatment.

The drum type washing machine wholly maintains an antibacterial property by treating the drum 14 with the Kimchi lactic acid bacteria culture. Since the drum 14 contacts the laundry, it can give the antibacterial property to the laundry. The drum 14 is normally made of a stainless material. Therefore, the drum 14 is preferably coated with the Kimchi lactic acid bacteria culture.

The antibacterial property of the laundry can be improved by treating the lifts 16 more closely contacting the laundry than the drum 14 with the Kimchi lactic acid bacteria culture. In the viewpoint of improving the antibacterial property of the laundry, treating the lifts 16 with the Kimchi lactic acid bacteria culture is easier and cheaper than treating the whole drum 14 with the Kimchi lactic acid bacteria culture. The lifts 16 are coupled to the drum 14 by a screw or the like. Therefore, the coupling portions of the drum 14 and the lifts 16 may be contaminated with the alien substances and detergent residues. The tub 10 can be protected from such contamination by treating the lifts 16 with the Kimchi lactic acid bacteria culture.

Referring to FIG. 1, the door 24 is not flat, so that the wash water or detergent may be left on the door 24. If the door 24 is contaminated, it gives out a bad smell. In addition, if the contaminated door 24 contacts the laundry, the washing effect is reduced. The door 24 can be protected from such contamination by the Kimchi lactic acid bacteria culture treatment.

Furthermore, the whole drum type washing machine can be protected from contamination by treating the water supply hose 32, the water supply valve 34, the drain hose 40 and the drain pump 38 with the Kimchi lactic acid bacteria culture. The laundry and the drain water can have the antibacterial property by treating the water passage with the Kimchi lactic acid bacteria culture. Here, the antibacterial property can be provided by installing a filter containing the Kimchi lactic acid bacteria culture on the passage.

Figure 3:
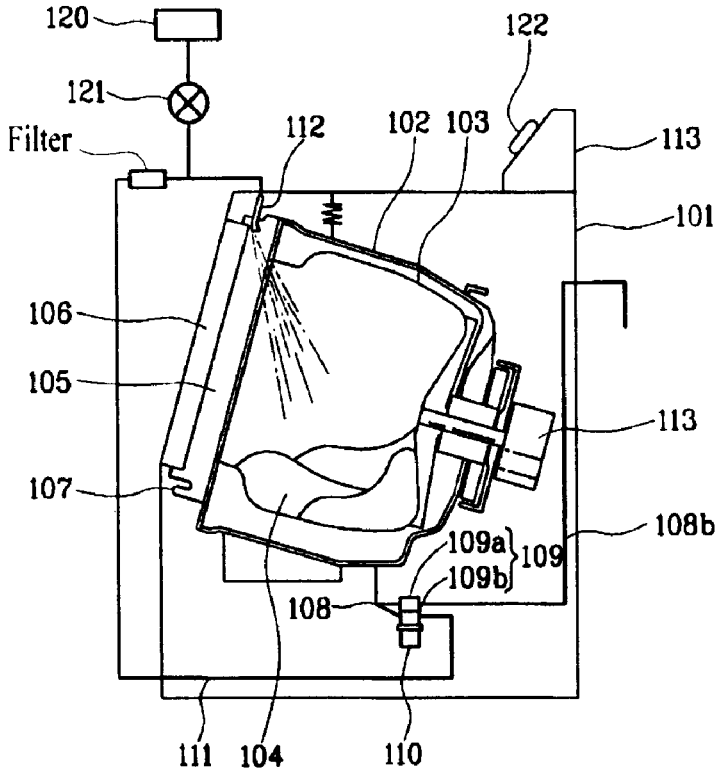
FIG. 3 is an exemplary view illustrating a state where the present invention is applied to a drum type washing machine having a recirculation passage.

FIG. 3 is an exemplary view illustrating a state where the present invention is applied to a drum type washing machine having a recirculation passage. The drum type washing machine includes a cabinet 101 for forming the external appearance, a tub 102 installed inside the cabinet 101 and fixed by a damper and a spring for storing wash water, a drum 103 rotatably installed inside the tub 102, for performing washing, an inlet 105 formed on the front surface of the cabinet 101 so that the user can put the laundry 104 into the washing machine or take the laundry 104 out of the washing machine, a door 106 selectively opened and closed when the user puts the laundry 104 into the washing machine or takes the laundry 104 cut of the washing machine through the inlet 105, a gasket 107 installed between the tub 102 and the door 106, for absorbing vibration and preventing leakage of wash water in washing, and a drain passage 108 coupled to the bottom end of the tub 102, for externally discharging the wash water from the tub 102.

The drum type washing machine includes a recirculation passage 111 for recirculating wash water to improve the washing effect. The recirculation passage 111 includes the drain passage 108 for externally discharging wash water. A plurality of casings 109, a pump 110 installed on the bottom ends of the plurality of casings 109 to be rotatable to both directions, and a spray arm 112 installed on the end of the recirculation passage 111 for continuously spraying the wash water of the tub 102 to the laundry 104 are disposed on the recirculation passage 111. Generally, drainage and recirculation can be selected according to the rotation direction of the pump, by using an one way pump with a three way valve, two one way pumps, or a bi-directional pump with a double casing structure. The bi-directional pump with the doable casing is normally used.

The drain passage 108 is connected from the tub 102 to the bi-directional pump 110 disposed at the bottom end. Before connected to the pump 110, the drain passage 108 is connected to the casing 109 separated into upper and lower casings 109*a* and 109*b* on the top end of the pump 110. The drain passage 108*b* connected to the upper casing 109*a* is linked to the external space through the cabinet 101 of the washing machine, and the drain passage 108 connected to the lower casing 109*b* is linked to the spray arm 112 fixedly inserted into the upper portion of the gasket 107 to face the inside of the drum 103. In FIG. 3, the recirculation passage 111 is shown outside the cabinet 101 for easy understanding. Actually, the recirculation passage 111 is disposed inside the cabinet 101.

The operations of the above components will now be explained. When the user opens the door 106 adhered to the front surface of the main body of the washing machine, puts the laundry 104 into the washing machine, and inputs a wash command trough a control panel 113, water supply is started. When water is filled to a pre-determined level, a driving motor 113 is rotated, and the drum 10B interworking with the driving motor 113 is rotated, for performing washing or rinsing.

In the forward rotation, the bi-directional pump 110 composed of the plurality of casings 109 performs drainage, namely, simultaneously sucks the wash water from the tub 102 and the residual wash water from the recirculation passage 111, and externally discharges the wash water from the washing machine. In the backward rotation, the bi-directional pump 110 nozzle-sprays the wash water supplied to the lower casing 109*b* to the laundry 104 through the spray arm 112 along the recirculation passage 111 without affecting the flow of the wash water supplied to the upper casing 109*b*. The nozzle-sprayed wash water is recirculated into the inner tub in the washing and rinsing. As a result, washing efficiency can be improved by the reuse of the wash water and detergent and the laundry beating effect.

On the other hand, after the washing or rinsing, the pump 110 starts the drain rotation in the forward direction. Therefore, the wash water in the tub 102 and the residual wash water in the recirculation passage 111 are externally discharged along the drain passage 108*b* by suction force of the upper casing 109*a*.

Finally, in dehydration, most of the moisture contained in the laundry 104 is removed by centrifugal force, thereby finishing the whole washing process.

The first aspect of the present invention (FIG. 3) gives the antibacterial property to the recirculation passage 111, by coating the recirculation passage 111 with the Kimchi lactic acid bacteria culture, or molding the recirculation passage 111 with a material containing the Kimchi lactic acid bacteria culture. The recirculation passage 111, which is the long passage for wash water, is easily contaminatable. The recirculation passage 111 is treated with the Kimchi lactic acid bacteria culture with the antibacterial property, and thus protected from contamination.

*The method of coating or molding the recirculation passage 111 by using the Kimchi lactic acid bacteria culture will later be discussed.

The second aspect of the present invention (FIG. 3) gives the antibacterial property to wash water and protects the recirculation passage 111, by installing a filter (not shown) containing the Kimchi lactic acid bacteria culture on the recirculation passage 111. In the viewpoint of protecting the recirculation passage 111, the filter is preferably disposed upstream of the recirculation passage 111. In the viewpoint of giving the antibacterial property to wash water, the filter can be disposed upstream or downstream of the recirculation passage 111. Accordingly, the filter can be disposed on the recirculation passage 111 in a multiple number. The filter containing the Kimchi lactic acid bacteria culture will later be described.

The third aspect of the present invention (FIG. 3) gives the antibacterial property to the wash water, washing machine and laundry, by installing a container 120 containing the liquid or powder phase Kimchi lactic acid bacteria culture on the recirculation passage 111 to supply the Kimchi lactic acid bacteria culture to the wash water. Especially, the third aspect of the present invention gives the antibacterial property by continuously or selectively supplying the Kimchi lactic acid bacteria culture to the wash water and washing machine through the recirculation passage 111, without using any special configuration. Preferably, a valve 121 is additionally installed to selectively supply the Kimchi lactic acid bacteria culture from the container 120. The operation of the valve 121 is controlled by a control unit (not Shown) for controlling the whole washing process. In addition, an operation button 122 can be added to the control panel 113, so that the user can select the operation of the valve 121.

Figure 4:
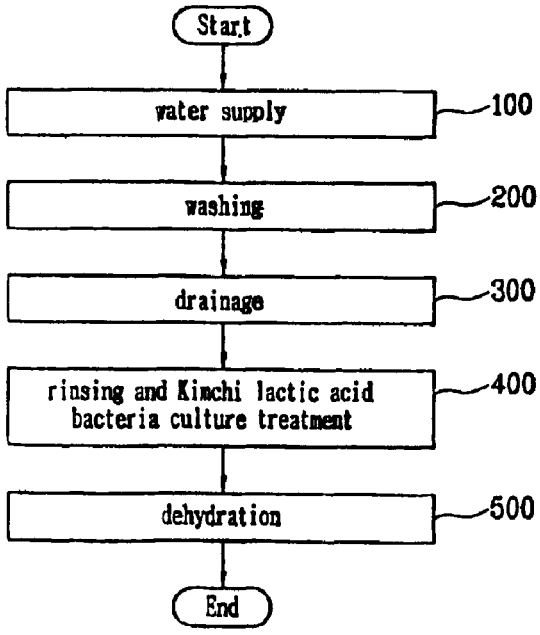
FIG. 4 is a flowchart showing one example of a washing process in accordance with the present invention.

The fourth aspect of the present invention (FIG. 3) gives the antibacterial property to the inside of the drum 103 or the laundry by selectively supplying the Kimchi lactic acid bacteria culture during the washing, by installing the container 102 containing the Kimchi lactic acid bacteria culture, the spray arm or nozzle 112 installed toward the inside of the drum 103, and the valve 121 for controlling the Kimchi lactic acid bacteria culture to be supplied from the container 120 to the drum 103 through the spray arm or the nozzle 112, without requiring any configuration for recirculation of wash water. Preferably, while the Kimchi lactic acid bacteria culture is supplied, the drum 103 is rotated to transfer the Kimchi lactic acid bacteria culture to the whole laundry, wash water or drum;

FIG. 4 is a flowchart showing one example of a washing process in accordance with the present invention. First, water is supplied (100; water supply). The laundry is washed (200; washing), water is drained (300; drainage), and the laundry is rinsed preferably after dehydration (400; rinsing). The above procedure is repeated according to selection of the user. The laundry is dehydrated (500; dehydration), thereby finishing the whole washing process.

In any step of the washing process, the Kimchi lactic acid bacteria culture can be supplied into the drum 103. In accordance with one preferred embodiment of the present invention, in the rinsing 400, the Kimchi lactic acid bacteria culture is supplied into the drum 103 through the recirculation passage 111. As the Kimchi lactic acid bacteria culture is supplied in the rinsing 400, the Kimchi lactic acid bacteria culture is efficiently operated on the laundry. As a result, using efficiency of the Kimchi lactic acid bacteria culture is improved.

In the case that the recirculation passage 111 is not used (forth aspect), it is advantageous to supply the Kimchi lactic acid bacteria culture in the dehydration 500 in efficiency of the used amount.

In accordance with another preferred embodiment of the present invention, when the Kimchi lactic acid bacteria culture is supplied, the drum 103 is rotated to wholly evenly supply the Kimchi lactic acid bacteria culture to the laundry. More preferably, the drum 103 is rotated at a speed lower than a speed equivalent to 1 G, namely, a speed of rotating the laundry sticking to the drum 103 by centrifugal force, for wholly evenly supplying the Kimchi lactic acid bacteria culture to the laundry.

Figure 5:
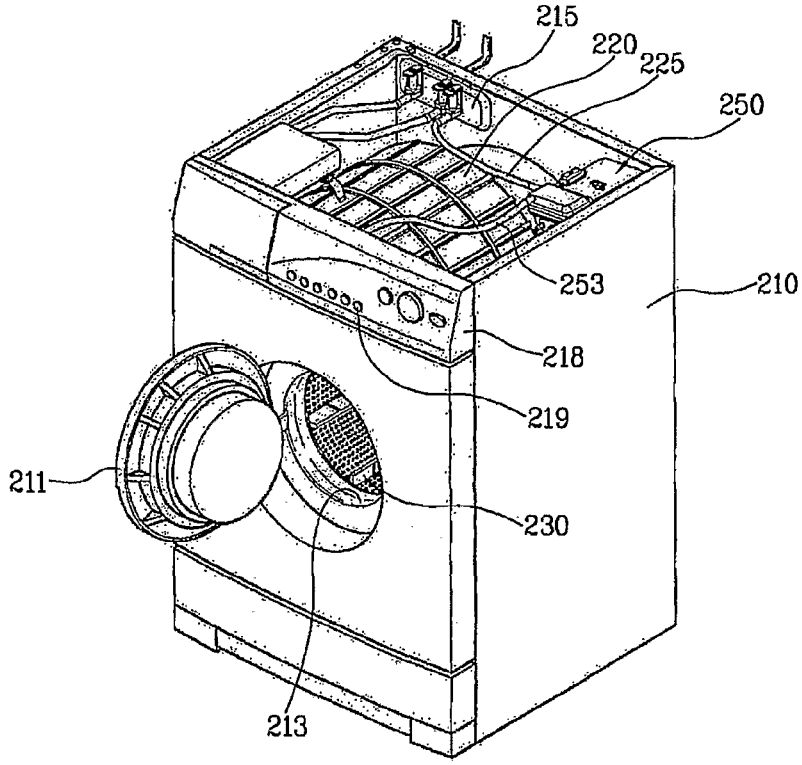
FIG. 5 is a structure view illustrating one example of a drying machine in accordance with the present invention.

FIG. 5 is a structure view illustrating one example of a drying machine in accordance with the present invention. The drying machine includes a cabinet 210 for forming the external appearance, a cylindrical tub 220 supported in the cabinet 210, for storing wash water, a drum 230 rotatably installed inside the tub 220 and supplied with the laundry, a driving motor (not shown) for driving the drum 230, and a steam generator 250 for supplying steam into the drum 230.

An inlet 213 communicating with the inside of the drum 230 is formed on the front surface of the cabinet 210, so that the user can put the laundry into the drying machine or take the laundry out of the drying machine. A door 211 for opening and closing the inlet 213 is installed to be rotatable to the front direction. On the other hand, a water supply valve 215 and a water supply hose 225 connected to an external water pipe (not shown) for supplying wash water to the tub 220 are installed at one side of the drying machine.

The steam generator 250 is connected to the water supply hose 225 and supplied with water. The steam generator 250 generates steam by heating water and supplies the steam to the drum 230. A steam supply hose 253, which is a path for guiding the steam generated in the steam generator 250 into the drum 230, is installed at one side of the steam generator 250. Preferably, the steam supply hose 253 has a nozzle-shaped end (steam outlet) to smoothly spray steam into the inside space of the drum 230. Preferably, the end of the steam supply hose 253 which discharges the steam is exposed to the inside of the drum 230.

An operation panel 218 is formed at the front upper portion of the cabinet 210. The operation panel 218 interworks with a control means (not shown) to control the whole operations of the drying machine. Preferably, if necessary, the user can supply the steam and Kimchi bacteria to the drum 230 by controlling the operations of the steam generator 250 and a container 200 containing the Kimchi bacteria discussed later, by clicking an operation button 219.

Figure 6:
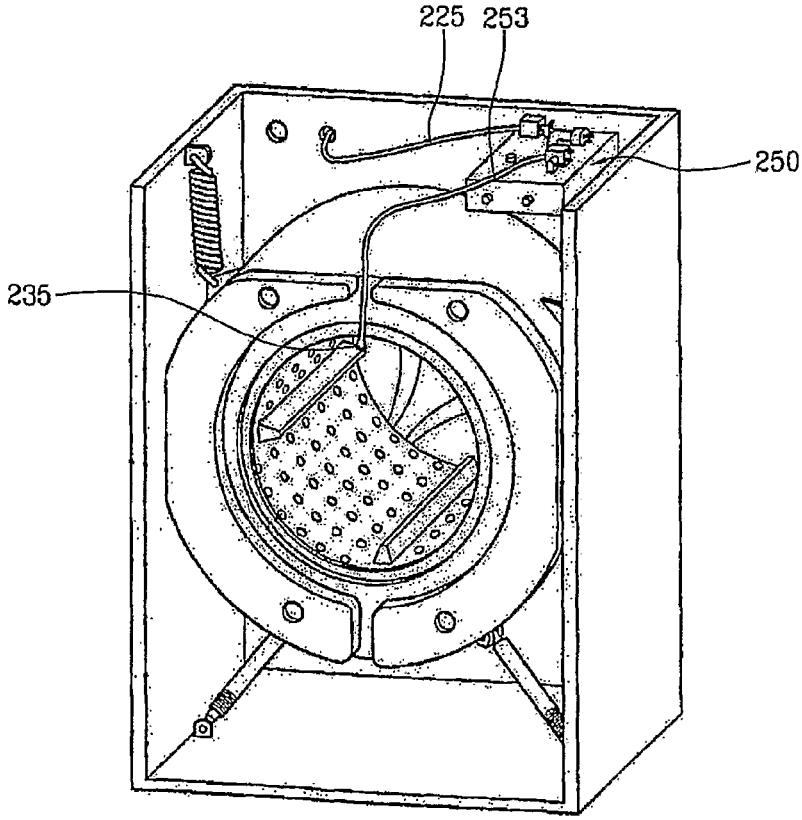
FIG. 6 is a structure view illustrating another example of the drying machine in accordance with the present invention.

FIG. 6 is a structure view illustrating another example of the drying machine in accordance with the present invention. A water supply hose 225, a steam generator 250, a steam supply hose 253 and a nozzle 235 form a steam passage.

Figure 7:
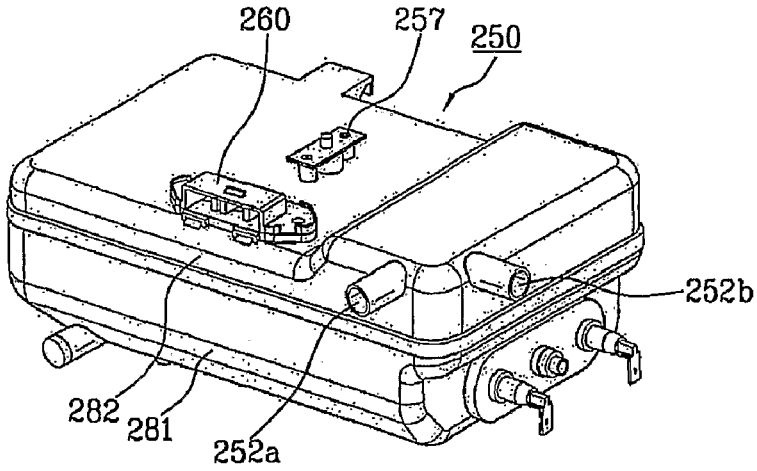
FIGS. 7 and 8 are structure views illustrating one example of a steam generator in accordance with the present invention.
Figure 8:
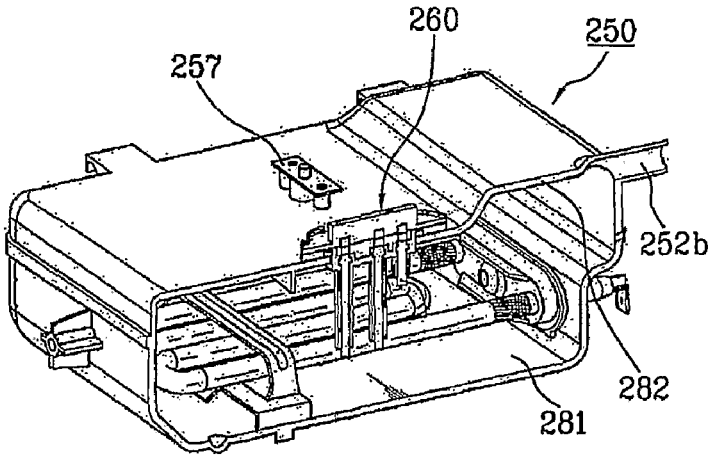

FIGS. 7 and 8 are structure views illustrating one example of the steam generator in accordance with the present invention. The steam generator 250 includes a lower housing 281 for forming the external appearance, and also forming a space for storing water, an upper housing 282 coupled to the top surface of the lower bossing 281, and a heater 255 for heating the water stored in the steam generator 250.

A water supply hole 252*a* connected to the water supply valve 215 for supplying water into the steam generator 250 is formed at one side of the upper housing 282, and a discharge hole 252*b* connected to the steam supply hose 253 for supplying the generated steam into the drum 220 is formed at the other side thereof.

The heater 255 is installed at the lower portion of the upper housing 281. In a state where the heater 255 is soaked in water filled in the steam generator 250, the heater 255 is operated to directly heat water.

A water level sensor 260 for sensing a level of the stored water, and a temperature sensor 257 for sensing temperatures of the water and steam heated by the heater 255 are installed at one side of the upper housing 282. In addition, the temperature sensor 257 senses the temperature of the steam generated in the steam generator 250. When the sensed temperature exceeds a reference value, power supply to the heater 255 is intercepted to prevent overheating. The water level sensor 260 senses the level of the water stored in the steam generator 250, for keeping the optimum water level.

The steam generator 250 can be applied to the drum type drying machine. Differently from the washing machine, the drying machine is not connected to the water pipe. Therefore, the water supply hose 225 is connected to a special water supply tank. In the washing machine, the water supply hose 225 can be also connected to the water supply tank.

The washing machine and the drying machine can supply steam to the laundry by using the steam generator 250. The high temperature high humidity steam serves to remove pleats of the laundry.

The first aspect of the present invention (FIG. 5) gives the antibacterial property to the easily-contaminatable steam passage, by coating the steam passage with the Kimchi lactic acid bacteria culture or molding the steam passage with a material containing the Kimchi lactic acid bacteria culture. The steam passage, which is the passage for the high temperature high humidity steam, is easily contaminatable. The steam passage is treated with the Kimchi lactic acid bacteria culture with the antibacterial property, and thus protected from contamination.

The method of coating or molding the steam passage by using the Kimchi lactic acid bacteria culture will later be discussed.

The second aspect of the present invention (FIG. 5) gives the antibacterial property to steam and protects the steam passage, by installing a filter (not shown) containing the Kimchi lactic acid bacteria culture on the steam passage. In the viewpoint of protecting the steam passage, the filter is preferably disposed upstream of the steam passage. In the viewpoint of giving the antibacterial property to steam, the filter can be disposed upstream or downstream of the steam passage. Accordingly, the filter can be disposed on the steam passage in a multiple number.

The filter containing the Kimchi lactic acid bacteria culture will later be described.

Figure 9:
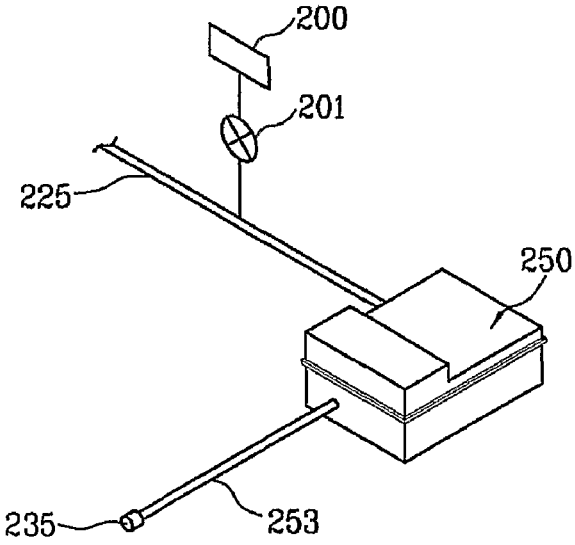
FIG. 9 is a structure view illustrating one example of steam passage configuration in accordance with the present invention.

The third aspect of the present invention (FIG. 5) gives the antibacterial property to the steam, drying machine and laundry, by installing the container 200 containing the liquid or powder phase Kimchi lactic acid bacteria culture on the steam passage to supply the Kimchi lactic acid bacteria culture to the steam Especially, the third aspect of the present invention gives the antibacterial property by continuously or selectively supplying the Kimchi lactic acid bacteria culture to the steam and laundry through the steam passage, without using any special configuration. Preferably, as shown in FIG. 9, a valve 201 is additionally installed to selectively supply the Kimchi lactic acid bacteria culture from the container 200. The operation of the valve 201 is controlled by a control means (not shown) for controlling the whole washing process. In addition, the operation button 219 can be added to the control panel 218, so that the user can select the operation of the valve 201.

Figure 10:
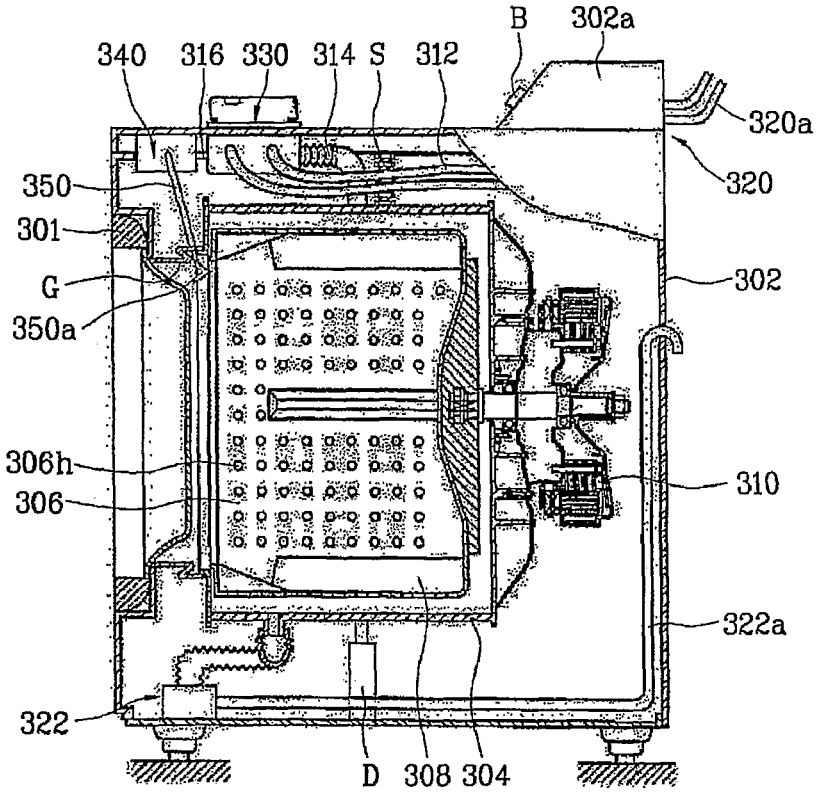
FIG. 10 is a structure view illustrating a steam jet drum type washing machine in accordance with the present invention.
Figure 11:
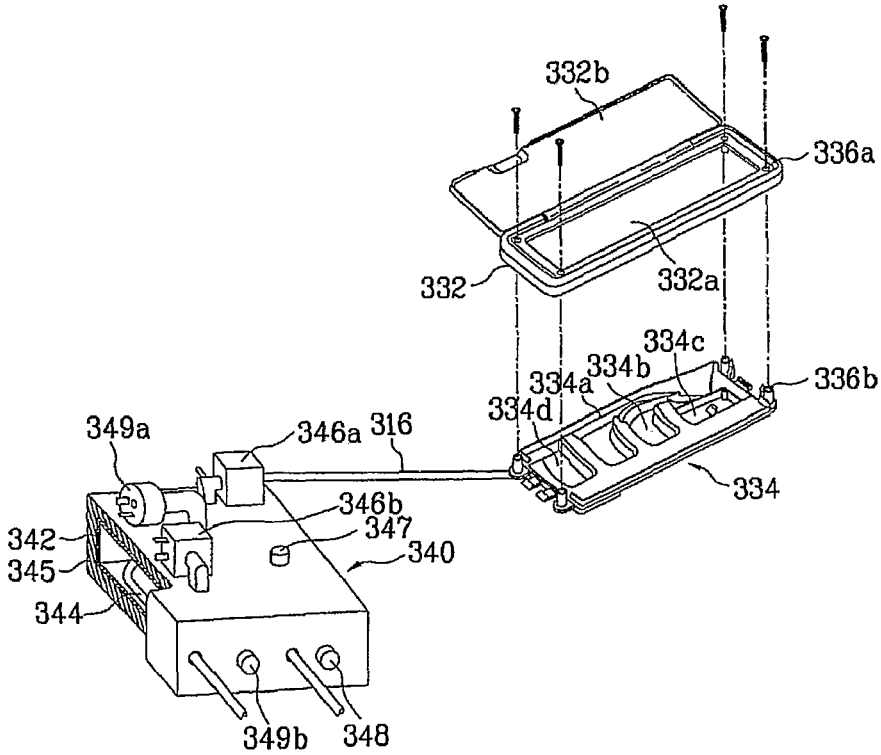
FIG. 11 is a structure view illustrating one example of a detergent box assembly in accordance with the present invention.

FIG. 10 is a structure view illustrating a steam jet drum type washing machine in accordance with the present invention, and FIG. 11 is a structure view illustrating one example of a detergent box assembly in accordance with the present invention.

As illustrated in FIG. 10, the steam jet drum type washing machine includes a cabinet 302 having an inlet H on its front surface, and also having a door 301 opened and closed on the inlet H, a tub 304 installed to be hung in the cabinet 302, a drum 306 rotatably installed inside the tub 304, for performing washing, a water supply valve assembly 320 installed at one side of the cabinet 302, for controlling supply of wash water, a detergent box assembly 330 connected to the water supply valve assembly 320, and composed of storage spaces for storing various detergents and Kimchi lactic acid bacteria culture, respectively, a steam generation device 340 connected to the water supply valve assembly 320 and the detergent box assembly 330, for heating the wash water containing the Kimchi lactic acid bacteria culture and spraying the steam, and a control means (not shown) for adjusting supply of the detergents and water by controlling the operations of the water supply valve assembly 320 and the detergent box assembly 330.

The cabinet 302 houses various components. Operation buttons B for controlling the whole washing process are formed on a control panel 302*a* at the rear portion of the top surface of the cabinet 302, the water supply valve assembly 32D is built in the top rear portion of the cabinet 302, and the detergent box assembly 330 and the steam generation device 340 are built in the top front portion of the cabinet 302.

The user can select various washing courses and set the intensity and time of each washing course through the operation buttons B. The operation buttons B can include a Kimchi lactic acid bacteria culture sterilization button (not shown) for steam-spraying the Kimchi lactic acid bacteria culture and wash water by controlling the operations of the water supply valve assembly 320 and the steam generation device 340 daring the washing process.

The tab 304 is formed in a cylindrical shape with its front surface opened. The tub 304 is hung in the cabinet 302 by a spring S and supported by a damper D, for absorbing vibration. The front end of the tub 304 is connected to the inlet H through a gasket G, for preventing water leakage. A motor 310 is mounted on the rear end of the tub 304 and connected to the drum 306, for transmitting power.

Here, the motors 310 can be differently disposed at the lower portion of the tub 304, for indirectly transmitting power to the drum 306 through a pulley and a belt, or coaxially disposed with the drum 306 at the lower center portion of the tub 304, for directly transmitting power to the drum 306.

A drain pump assembly 322 having a drain pump for draining wash water is installed at the lower portion of the tub 304 and connected to the control means. A drain hose 322*a* connected to the drain pump assembly 322 is externally extended to discharge wash water during the washing process.

The drum 306 is formed in a cylindrical shape with its front surface opened. A plurality of dehydration holes 306*h* are formed on the wall of the drum 306, so that the wash water can flow through the dehydration holes 306*h*. Lifts 308 are installed on the cylindrical surface of the drum 306 in the circumferential direction at predetermined intervals. When the drum 306 is rotated, the lifts 308 are rotated to lift and drop the laundry.

In dehydration, when the drum 306 is rotated at a high speed by the motor 310, the wash water is separated from the laundry by the centrifugal force, and collected on the bottom surface of the tub 304 through the dehydration holes 306*h*. When the drain pump assembly 322 is operated, the wash water is externally discharged.

The water supply valve assembly 320 is built in the top rear portion of the cabinet 302 to be disposed below the control panel 302*a*, and connected to the water supply hose 322*a* for supplying wash water. A water supply valve (not shown) is installed in a water supply valve housing (not shown). The water supply valve assembly 320 is also connected to a water supply hose 320*a* connected directly to a water pipe for supplying wash water.

The water supply valve assembly 32D and the detergent box assembly 330 are connected through a water supply bellows 312. Various wash water supply passages are formed so that the wash water can sequentially flow into each storage space of the detergent box assembly 330 and dissolve various detergents stored in the storage spaces.

Referring to FIG. 11, the detergent box assembly 330 is mounted on a mounting groove (not shown) on the top surface of the cabinet 302. The detergent box assembly 330 includes a lead frame 332 having a long opening unit 332*a* settled on the periphery of the mounting groove and a hinge-coupled lead 332*b*, and a detergent box 334 mounted on the mounting groove of the cabinet 302 through the opening unit 332*a* of the lead frame 332, and partitioned off into the storage spaces 334*a*, 334*b*, 334*c* and 334*d* for individually storing the detergent, bleaching agent, fabric softener and Kimchi lactic acid bacteria culture.

In a state where the lead frame 332 is put on the detergent box 334, a plurality of mounting holes 336*a* formed on the periphery of the lead frame 332 are bolt-coupled to a plurality of fastening bosses 336*b* formed on the periphery of the detergent box 334. The assembled detergent box assembly 330 is settled on the mounting groove.

Especially, in the detergent box 334, the storage spaces 334*a*, 334*b* and 334*c* for individually storing the detergent, bleaching agent and fabric softener are inclined with their one side opened, so that various detergents dissolved in wash water can flow down. On the other hand, the storage space 334*d* for storing the Kimchi lactic acid bacteria culture is formed as a container with its top surface opened, and completely isolated from the other storages spaces 334*a*, 334*b* and 334*c*. Accordingly, the storage space 334*d* can store the Kimchi lactic acid bacteria culture in a powder or concentrate type.

Except the storage space 334*d* for storing the Kimchi lactic acid bacteria culture, the storage spaces 334*a*, 334*b* and 334*c* of the detergent box assembly 330 are connected to the top end of the tub 304 through an inflow bellows 314, for supplying the detergent, bleaching agent and fabric softener into the tub 304. Conversely, the storage space 334*d* for storing the Kimchi lactic acid bacteria culture is connected to the steam generation device 340 through a connection tube 316, for supplying the wash water containing the Kimchi lactic acid bacteria culture into the steam generation device 340. The steam generation device 340 heats and steam-sprays the Kimchi lactic acid bacteria culture, thereby improving the antibacterial and sterilizing effects.

Preferably, the steam generation device 340 is disposed at the upper portion of the tub 304 for easy repair and inspection. The steam generation device 340 is connected to the connection tube 316 linked to the detergent box assembly 330, for receiving and heating wash water, and also connected to the spray nozzle 350 linked to the top end of the gasket G, for spraying the heated steam into the tub 304. The end 350*a* of the spray nozzle 350 is expanded to widely spray the steam.

In detail, the steam generation device 340 includes an airtight pressure vessel 342 having a space for storing wash water, a heater 344 installed inside the pressure vessel 342, for heating wash water, an inflow valve 346*a* installed between the connection tube 316 and the pressure vessel 342, for controlling supply of wash water, and an outflow valve 346*b* installed between the spray nozzle 350 and the pressure vessel 342, for controlling outflow of steam.

The inflow valve 346*a* and the outflow valve 346*b* are pressure valves for controlling opening and closing according to the internal pressure of the pressure vessel 342. The inflow valve 346*a* and the outflow valve 346*b* are electronically or mechanically controlled so that the inflow valve 346*a* can be opened when the internal pressure is below a predetermined pressure, and that the outflow valve 346*b* can be opened when the internal pressure is over the predetermined pressure.

In addition, the steam generation device 340 includes a water level sensor 347 installed at the upper portion of the pressure vessel 342, for sensing a supply amount of wash water in the pressure vessel 342, and controlling the operations of the inflow valve 346*a* and the outflow valve 346*b*, and a temperature sensor 348 installed at the lower portion of the pressure vessel 342, for controlling the operation of the heater 344 according to the internal temperature of the pressure vessel 342. The water level sensor 347 senses the level of the wash water according to movement of floats on the surface of the water, or variation of the internal pressure of the pressure vessel 342 by water supply.

The heater 344 is installed at the lower portion of the pressure vessel 342, for heating even a small amount of wash water supplied to the pressure vessel 342. The heater 344 is an electric heater operated by power supply. Therefore, a safety means is needed to prevent overheating of the heater 344.

The safety means includes an automatic pressure switch 349*a* installed at one side of the water level sensor 347, for primarily stopping the operation of the heater 344 when the internal pressure of the pressure vessel 342 is over a set pressure Po, and an automatic temperature switch 349*b*, such as a thermostat, installed at one side of the temperature sensor 348, for secondarily stopping the operation of the heater 344 when the internal temperature of the pressure vessel 342 is over a set temperature To.

The automatic temperature switch 349*b* can be further supplementary installed to prevent overheating of the heater 344, when the automatic pressure switch 349 is not normally operated or leakage occurs in the pressure vessel 342.

The steam generation device 340 further includes an insulation material 345, such as Styrofoam, for surrounding the cuter portion of the pressure vessel 342 to prevent external heat loss during the operation of the heater 344.

The steam generation device 340 can be connected to the connection tube 316 linked to the detergent box assembly 330, and also connected directly to the water supply bellows 312 linked to the water supply valve assembly 320, for steam-spraying wash water with the Kimchi lactic acid bacteria culture, or steam-spraying only wash water.

The control means is a kind of microcomputer built in the top rear portion of the cabinet 302, for controlling the operations of various components according to the control signals from the operation buttons B or the pre-inputted washing process. The control means controls the motor 310, the water supply valve, the drain pump and the steam generation device 340.

The control means can supply the Kimchi lactic acid bacteria culture stored in the storage space 334*d* of the detergent box 334 to the steam generation device 340 with wash water in the last rinsing by controlling the operation of the water supply valve according to the preset washing courses. In addition, the control means can supply the Kimchi lactic acid bacteria culture stored in the storage space 334*d* of the detergent box 334 to the steam generation device 340 with wash water in the selected time point of the washing process, by controlling the operation of the water supply valve according to the control signal from the Kimchi lactic acid bacteria culture sterilization button. At the same time, the control means controls the steam generation device 340 to spray the Kimchi lactic acid bacteria culture and the steam into the tub 304.

Here, the control means can control the steam generation device 340 to steam-spray the Kimchi lactic acid bacteria culture in the last rinsing or selectively steam-spray the Kimchi lactic acid bacteria culture daring the washing courses.

Figure 12:
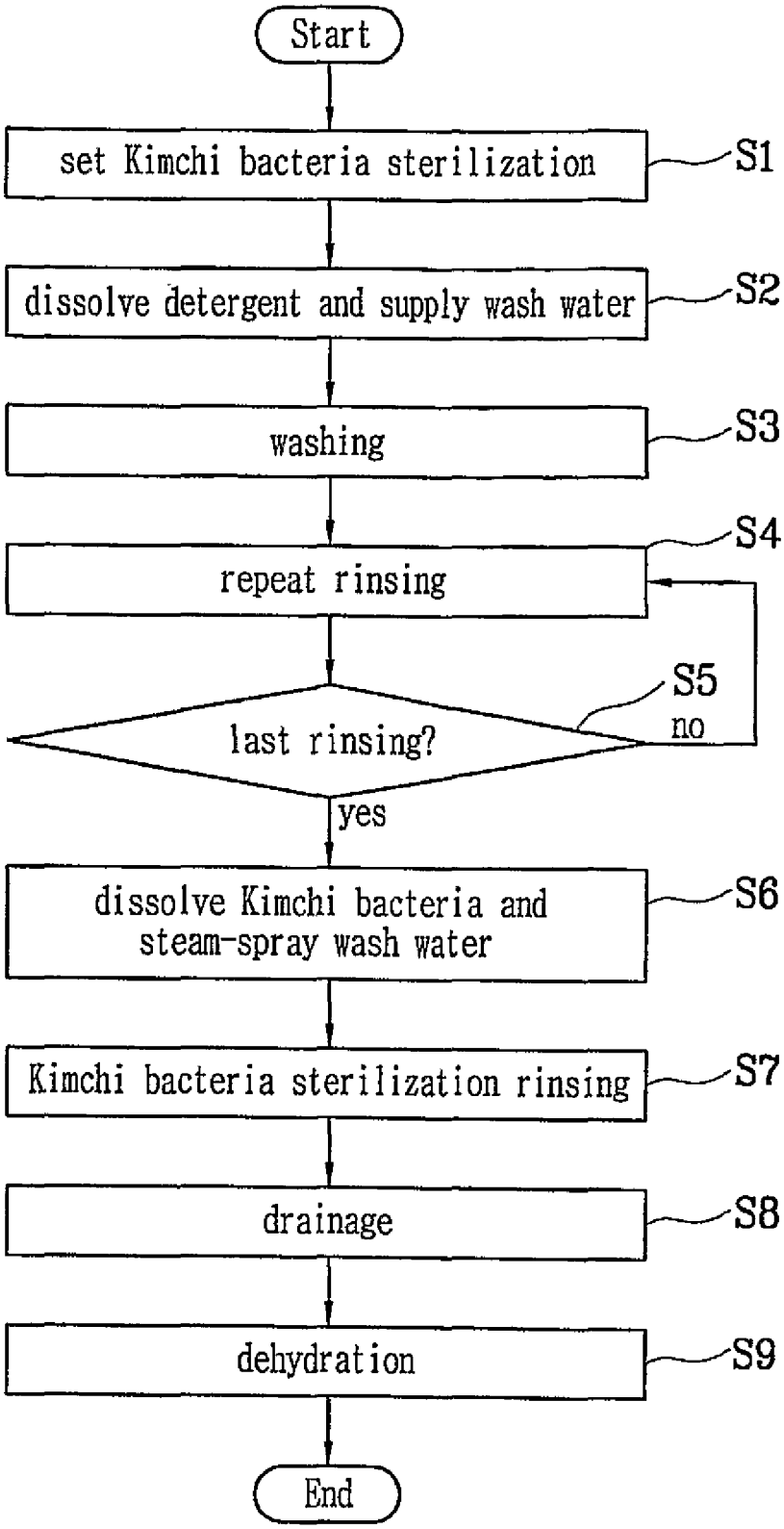
FIG. 12 is a flowchart showing another example of the washing process in accordance with the present invention.

FIG. 12 is a flowchart showing the antibacterial and sterilizing washing process of the steam jet drum type washing machine in accordance with the present invention.

The antibacterial and sterilizing washing process of the steam jet drum type washing machine will now be explained with reference to FIG. 12.

In a first step, when the user sets the Kimchi lactic acid bacteria culture sterilization and operates the washing machine, the amount of the laundry is sensed, the detergent is dissolved, and wash water is supplied (refer to S1 and S2).

The user puts the Kimchi lactic acid bacteria culture into the storage space 344*d* for storing the Kimchi lactic acid bacteria culture and sets the washing courses, washing intensity and washing time through the operation buttons B. Especially, the user can selectively add the Kimchi lactic acid bacteria culture sterilization to the washing process through the Kimchi lactic acid bacteria culture sterilization button. Therefore, the Kimchi lactic acid bacteria culture sterilization is carried oat in the last rinsing to improve the antibacterial effect and the sterilizing effect. In another case, the user can select the washing process including the Kimchi lactic acid bacteria culture sterilization without using the Kimchi lactic acid bacteria culture sterilization button.

After the Kimchi lactic acid bacteria culture sterilization is added, the control means senses the amount of the laundry by rotating the drum 306 by driving the motor 310, sets the water level according to the amount of the laundry, and gradually opens the water supply valve to that wash water can flow into the storage spaces 334*a* and 334*b* for storing the detergent and the bleaching agent in the detergent box 334.

When the water supply valve is opened, the wash water supplied through the water supply hose 322*a* and the water supply bellows 312 is sprayed to the detergent and the bleaching agent stored in the storage spaces 334*a* and 334*b* of the detergent box 334. Accordingly, the detergent and the bleaching agent are dissolved and supplied into the tub 304 through the inflow bellows 314.

The control means dissolves the detergent and makes the laundry wet during water supply by rotating the drum 306 by the motor 310, and supplies wash water to the tub 304 and the drum 306 by the set water level.

In a second step, after wash water is supplied in the first step, washing is performed, and then rinsing is repeatedly performed (refer to S3 and S4).

The control means rotates the drum 306 and the lifts 308 at the same time by driving the motor 310, thereby forming rotation streams in wash water and lifting and dropping the laundry for washing.

The control means drains the used wash water by controlling the operation of the drain pump assembly 322, and supplies new wash water into the tub 304 and the drum 306 by opening the water supply valve. Thereafter, the control means alternately rotates the tub 306 and the lifts 308 to one or both directions by driving the motor 310, thereby forming rotation streams in wash water and lifting and dropping the laundry for rinsing.

Such rinsing is repeatedly carried cat two or three times. In the rinsing just before the last rinsing the control means opens the water supply valve to supply wash water to the storage space 334*c* for storing the fabric softener in the detergent box 334. The fabric softener in the detergent box 334 is dissolved and supplied with wash water.

In the washing and rinsing, the control means supplies wash water directly to the steam generation device 340. The steam generated by the steam generation device 340 is sprayed into the tub 304 though the spray nozzle 350, for improving the washing and rinsing effects.

In a third step, when the last rinsing is started in the second step, the Kimchi lactic acid bacteria culture is dissolved in wash water and steam-sprayed for the Kimchi lactic acid bacteria culture sterilization rinsing (refer to S5, S6 and S7).

Especially, in the last rinsing the control means opens the water supply valve, so that wash water can flow into the storage space 334*d* for storing the Kimchi lactic acid bacteria culture in the detergent box 334. The Kimchi lactic acid bacteria culture in the detergent box 334 is dissolved in wash water, and supplied to the steam generation device 340 throb the connection tube 316. The steam generation device 340 heats the wash water and the Kimchi lactic acid bacteria culture, and sprays the resulting steam into the tub 306 through the spray nozzle 350.

At the same time, the control means rotates the drum 306 and the lifts 308 to lift and drop the laundry by operating the motor 310. The laundry is evenly mixed and rinsed in the wash water containing the Kimchi lactic acid bacteria culture.

Here, the Kimchi lactic acid bacteria culture contained in the wash water infiltrates into the laundry and removes detergent residues and various bacteria sticking to the laundry.

As described above, the Kimchi lactic acid bacteria culture sterilization can be performed in the last rinsing. In addition, the Kimchi lactic acid bacteria culture sterilization can be set to be performed in another washing course through the Kimchi lactic acid bacteria culture sterilization button.

In a fourth step, after the Kimchi lactic acid bacteria culture sterilization is finished in the third step, wash water is drained and dehydration is carried out (refer to S8 and S9).

After finishing the last rinsing including the Kimchi lactic acid bacteria culture sterilization, the control means opens the drain pump assembly 322, and rotates the drum 306 and the lifts 308 to one direction at a high speed by driving the motor 310. As the laundry is rotated, sticking to the inner wall of the drum 306, moisture is separated from the laundry by the centrifugal force, and collected on the bottom sure of the tub 304 through the dehydration holes 306*h*.

As the drain pump assembly 322 is opened, the wash water collected on the bottom surface of the tub 306 is externally discharged along the drain hose 322*a*, thereby finishing the whole washing process.

Figure 13:
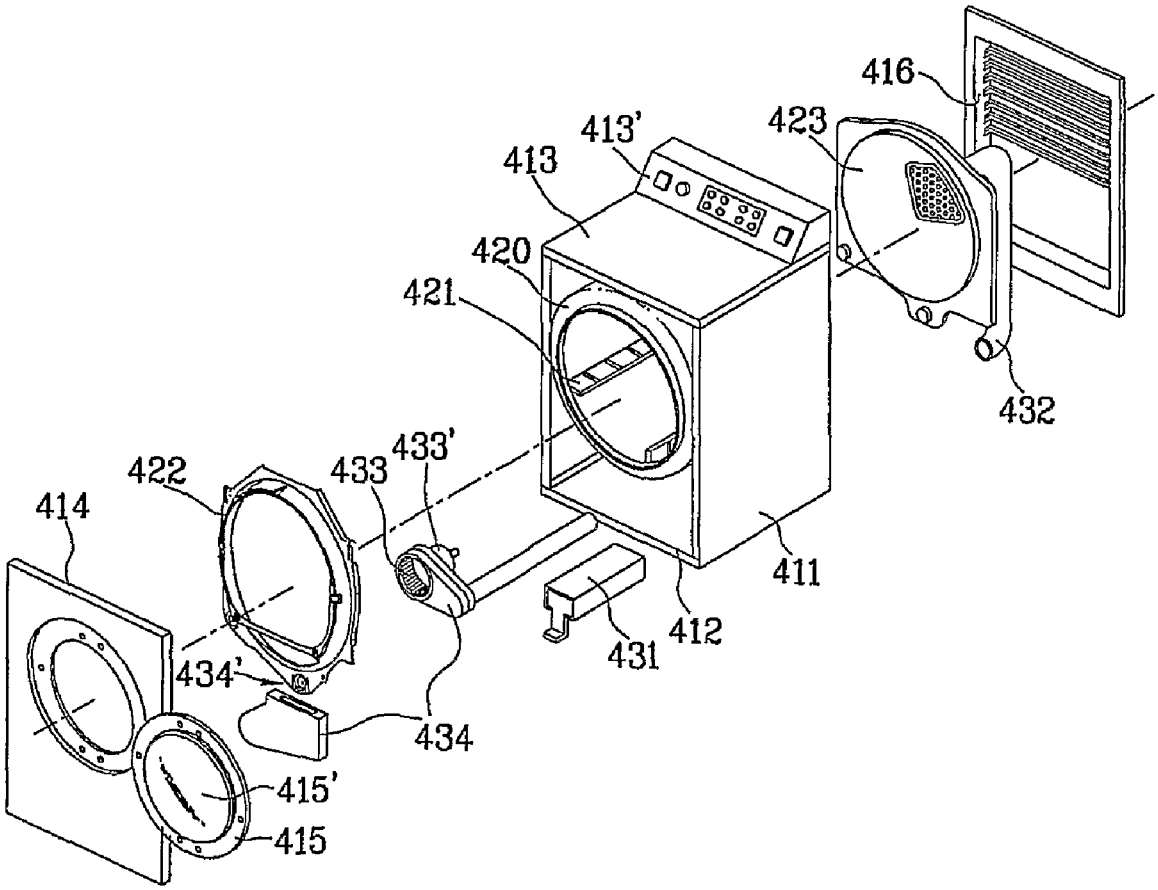
FIG. 13 is a structure view illustrating a dram type drying machine in accordance with the present invention.

FIG. 13 is a structure view illustrating a drum type drying machine in accordance with the present invention. The drum type drying machine includes a casing for forming the external appearance, a drying unit installed inside the casing a piping unit for supplying hot air to the drying unit and discharging mist, and a control means for controlling the whole operations of the components.

The casing includes a center cabinet 411 for forming a body of the machine, a base cover 412 installed at the lower portion of the center cabinet 411, a top cover 413 being installed at the upper portion of the center cabinet 411 and having an operation unit 413' a front frame 414 being installed on the front face of the center cabinet 411 and having a door frame 415 at its inlet side, and a rear frame 416 installed at the rear portion of the center cabinet 411. A door glass 415' is installed on the door frame 415 so that the user can check the state of the drying unit.

The drying unit includes a drum 42D being rotatably installed inside the center cabinet 411, and having a lift 421 for lifting the laundry in its length direction, a front supporter 422 installed between the front frame 414 and the drum 420, for supporting the front portion of the drum 420, and a rear supporter 423 installed between the rear frame 416 and the drum 420, for supporting the rear portion of the drum 420.

The drum 420 is connected to a driving motor (not shown) installed at its rear portion through a motor shaft, and rotated by rotation force from the driving motor. The control means controls the driving motor so that the drum 420 can be slowly rotated at a speed having centrifugal force below 1 G (1 gravity; if the centrifugal force is over 1 G, the laundry is rotated, sticking to the drum). The lift 421 lifts and drops the laundry, for evenly drying the laundry. In addition, the drum 420 is reversed to the bilateral direction, for evenly mixing and sterilizing the laundry.

The piping unit includes a heater 431 for generating hot air, a hot air supply duct 432 installed on the rear supporter 423, for supplying the hot air generated by the heater 431 to the rear portion of the drum 42D, an exhaust duct 434 installed on the front supporter 414, for externally discharging mist from the machine, a fan 433 installed at one side of the exhaust duct 434 and driven by a motor 433' and a filter assembly 434' with a lint filter installed on the front supporter 414 and disposed at the inlet side of the exhaust duct 434.

The hot air generated by the heater 431 is supplied into the drum 420 through the hot air supply duct 432, for evaporating moisture contained in the laundry in the drum 420 and drying the laundry. When the fan 433 is driven, the generated mist is externally discharged through the exhaust duct 434. Alien substances contained in the mist are not caught by the fan 433 but filtered off by the filter assembly 434' which prevents the breakdown of the machine.

The first aspect of the present invention (FIG. 13) treats the drum 420, the lifts 421 or both of them with the Kimchi lactic acid bacteria culture. The Kimchi lactic acid bacteria culture treatment can be carried cut by coating the Kimchi lactic acid bacteria culture on the drum 420 and/or the lift 421, or molding the drum 420 and/or the lift 421 with a material containing the Kimchi lactic acid bacteria culture. The drum type drying machine wholly maintains the antibacterial property by treating the drum 420 with the Kimchi lactic acid bacteria culture. Since the drum 420 contacts the laundry in the drying it can give the antibacterial property to the laundry. The drum 420 is, normally made of a stainless material. Therefore, the drum 420 is preferably coated with the Kimchi lactic acid bacteria culture.

The antibacterial property of the laundry can be improved by treating the lift 421 more closely contacting the laundry than the drum 420 with the Kimchi lactic acid bacteria culture. In the viewpoint of improving the antibacterial property of the laundry, treating the lift 421 with the Kimchi lactic acid bacteria culture is easier and cheaper than treating the whole drum 420 with the Kimchi lactic acid bacteria culture.

The method of performing the Kimchi lactic acid bacteria culture treatment will later be described in detail.

Figure 14:
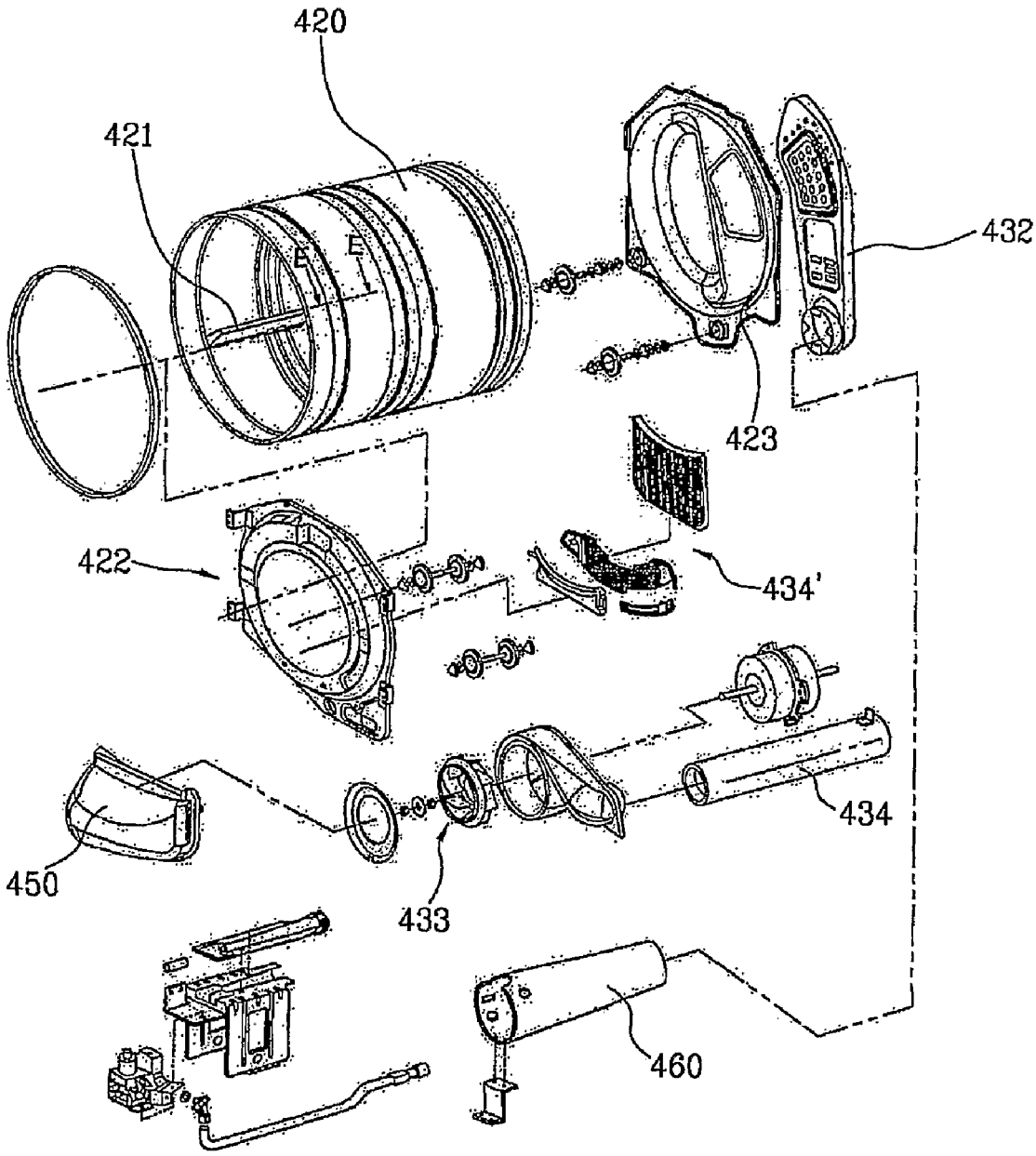
FIG. 14 is a structure view illustrating one example of a supply passage/exhaust passage of the drum type drying machine in accordance with the present invention.

The second aspect of the present invention (FIG. 13) treats the supply passage linked to the supply duct 432, the exhaust passage linked to the exhaust duct 434, or both of them with the Kimchi lactic acid bacteria culture. The Kimchi lactic acid bacteria culture treatment can be carried out by coating the Kimchi lactic acid bacteria culture on the supply passage and/or the exhaust passage, molding the supply passage and/or the exhaust passage with a material containing the Kimchi lactic acid bacteria culture, or installing a filter containing the Kimchi lactic acid bacteria culture on the supply passage and/or the exhaust passage. The supply passage and/or the exhaust passage are provided with the antibacterial property and protected from contamination by the Kimchi lactic acid bacteria culture treatment. Furthermore, the antibacterial property is given to the hot air passing through the passages. FIG. 14 is a structure view illustrating one example of the supply passage and the exhaust passage of the drum type drying machine in accordance with the present invention. Various components such as the supply duct 432, panel 460, heater 431, filter assembly 434' lint duct 450, fan 433 and exhaust duct 434 are formed on the passages. The above components can be selectively treated with the Kimchi lactic acid bacteria culture.

The third aspect of the present invention (FIG. 13) treats the filter assembly 434 with the lint filter disposed at the inlet side of the exhaust passage with the Kimchi lactic acid bacteria culture. Alien substances separated from the laundry are hooked on the lint filter or the filter assembly 434 in the drying, to cause contamination and propagate bacteria. In a worse case, the filter assembly 434 gives cut a bad smell. The third aspect of the present invention gives the antibacterial property to the filter assembly 434 by the Kimchi lactic acid bacteria culture treatment, thereby protecting the filter assembly 434' from contamination.

Figure 15:
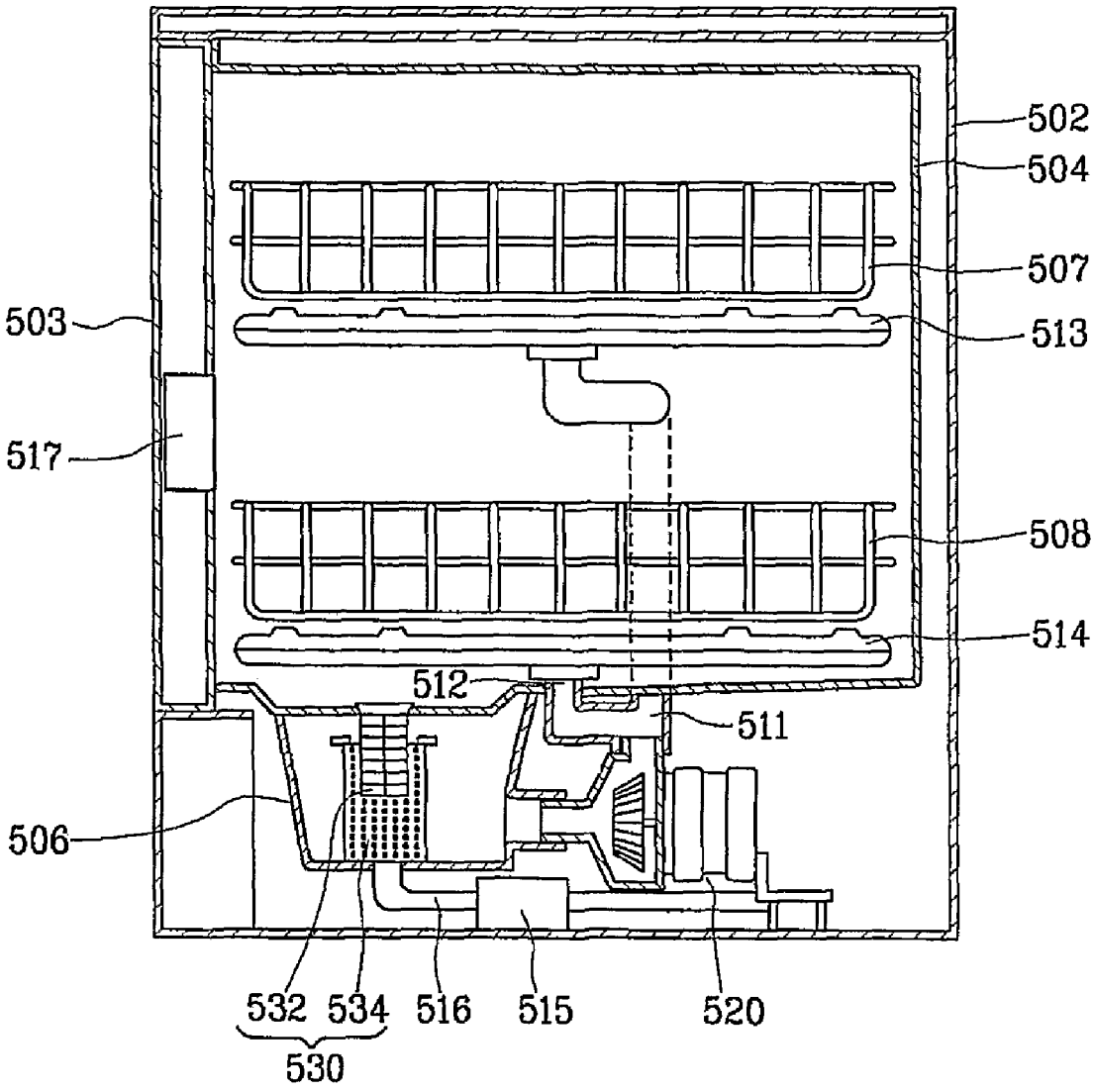
FIG. 15 is a structure view illustrating a dishwashing machine in accordance with the present invention.
Figure 16:
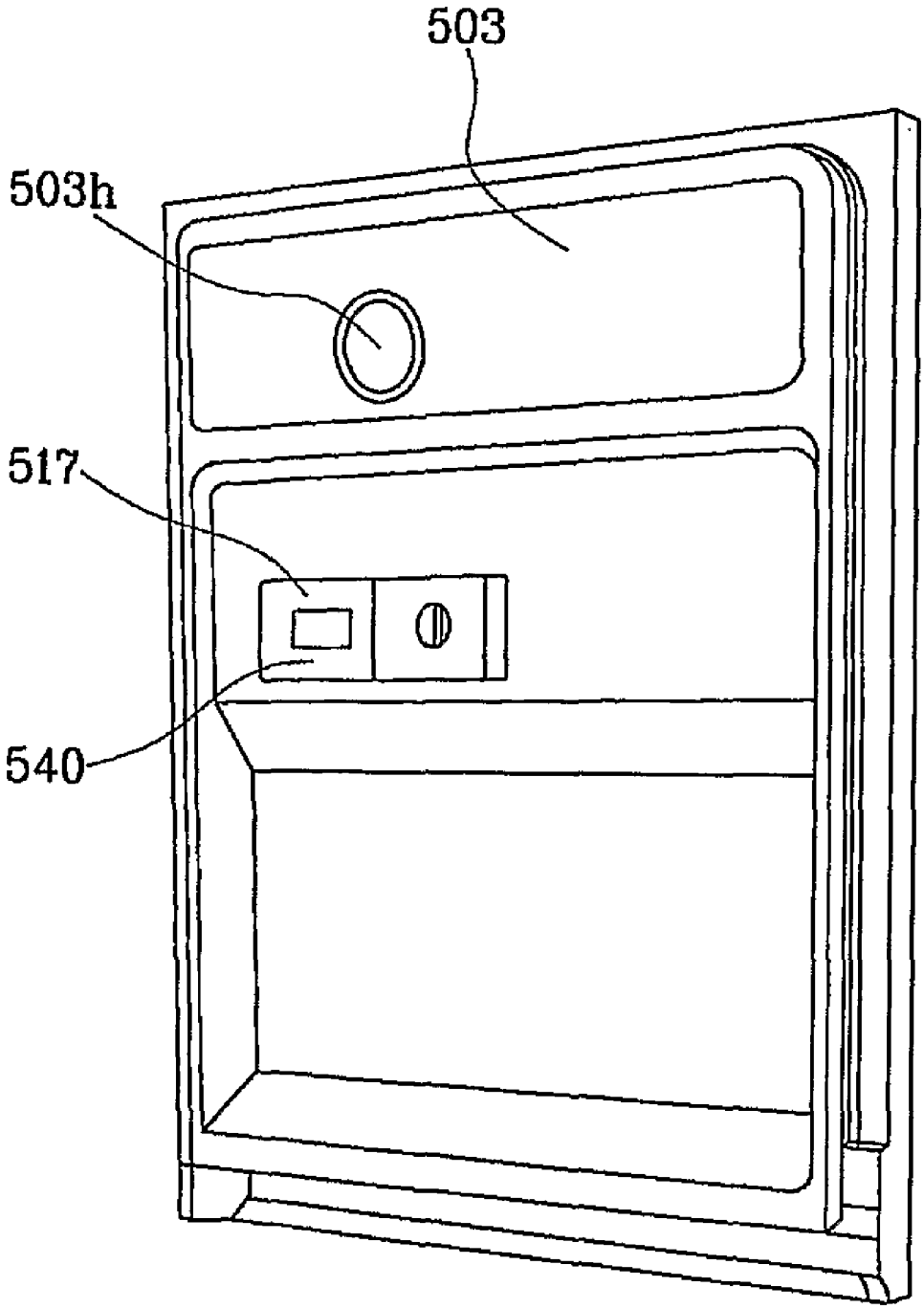
FIG. 16 is a structure view illustrating one example of a door of the dishwashing machine in accordance with the present invention.

FIG. 15 is a structure view illustrating a dishwashing machine in accordance with the present invention, and FIG. 16 is a structure view illustrating one example of a door of the dishwashing machine in accordance with the present invention. The dishwashing machine includes a main body 502 having its front surface opened, a door 503 installed on the front surface of the main body 502 to be opened and closed, a wash tub 504 installed inside the main body 502, for forming a dishwashing space, a water collection tank 506 formed on the bottom surface of the wash tub 504 and filled with wash water, upper and lower shelves 507 and 508 slidably mounted at the upper and lower portions of the wash tub 504 for dish alignment, upper and lower nozzles 513 and 514 installed at the ends of upper and lower passages 511 and 512 connected to the water collection tank 506, for spraying wash water, a wash pump assembly 520 for pumping the wash water in the water collection tank 506 to the upper and lower passages 511 and 512, a filter assembly 530 with a filter installed inside the water collection tank 506, for filtering off alien substances from the circulated wash water, a detergent container 517 installed inside the door 503, for supplying a detergent in dishwashing and a control means (not shown) for controlling the whole operations of the components.

A water supply valve (not shown) and a water supply tube (not shown) for supplying wash water into the water collection tank 506, and a drain pump 515 and a drain tube 516 for externally draining wash water from the water collection tank 506 are installed in the water collection tank 506. The drain tube 516 is connected to the lower portion of the water collection tank 506 on which the filter assembly 530 has been mounted, and the drain pump 515 is installed at the middle portion of the drain tube 516.

The main body 502 is formed in a rectangular shape with its front surface opened. The door 503 is installed on the front surface of the main body 502 to be opened and closed. A sealing unit (not shown) made of rubber is formed on the periphery of the door 503 contacting the front surface of the main body 502. Accordingly, the door 50B is firmly closed on the main body 502, so that the wash water sprayed into the wash tub 504 cannot be leaked between the main body 502 and the door 503.

The detergent container 517 for containing the dishwashing detergent is installed on the front surface of the door 503, for supplying the dishwashing detergent into the wash tub 504 in the dishwashing. Preferably, an exhaust hole 503*h* is formed at the upper portion of the detergent container 517 and a ventilation fan (not shown) is installed therein, for drying the dishes in the wash tub 504 by hot air and externally discharging mist.

An operation unit (not shown) is exposed to the front surface of the door 503, so that the user can set the operations of the components. The operation unit is connected to the control means. Accordingly, the user can select detailed items of the dishwashing, rinsing and drying courses.

Preferably, guide rails (not shown) are formed on both side inner walls of the wash tub 504 to face each other, so that the upper and lower shelves 507 and 508 can be slidably detachably mounted on the Side rails. Preferably, rollers (not shown) are formed on both sides of the upper and lower shelves 507 and 508 to move along the guide rails.

The water collection tank 506 is installed on the bottom surface of the wash tub 504 to collect wash water. The filter assembly 530 is mounted in the water collection tank 506, for filtering off various alien substances such as food leftovers from the wash water. When the wash pump assembly 520 installed at one side of the water collection tank 506 is operated, the filtered wash water is pumped and sprayed through the upper and lower nozzles 513 and 514, and when the drain pump assembly 515 disposed at the lower portion of the water collection tank 506 is operated, the used wash water is externally discharged through the drain tube 516.

A heater (not shown) is built in one side of the water collection tank 506, for heating wash water. Therefore, the dishes can be washed more clean.

The filter assembly 530 includes a first filter 532 for filtering off relatively large dirt from wash water, and a second filter 534 installed on the periphery of the first filter 532, for filtering off relatively small dirt from the wash water passing through the first filter 532. The filters 532 and 534 can be formed in various types. One example of the filters has been disclosed in FIG. 2 of Korea Laid-Open Patent 2005-62144 by the present inventors.

The upper and lower nozzles 513 and 514 are rotatably installed at the ends of the upper and lower passages 511 and 512 communicating with the wash pump assembly 520. The upper and lower nozzles 513 and 514 are disposed at the lower portions of the upper and lower shelves 507 and 508, respectively, and have nozzle holes (not shown) on their top surfaces to spray wash water toward the upper and lower shelves 507 and 508.

When spraying the wash water through the nozzle holes, the upper and lower nozzles 513 and 514 are rotated, to expand the water spray area.

The first aspect of the present invention (FIG. 15) treats the water collection tank 506 with the Kimchi lactic acid bacteria culture. The Kimchi lactic acid bacteria culture treatment can be carried out by coating the Kimchi lactic acid bacteria culture on the water collection tank 506, molding the water collection tank 506 with a material containing the Kimchi lactic acid bacteria culture, or installing a filter containing the Kimchi lactic acid bacteria culture in the water collection tank 506. On the other hand, the water collection tank 506 includes the filter 532 or 534. The water collection tank 506 can have the antibacterial property by treating the filter 532 or 534 with the Kimchi lactic acid bacteria culture. Both the water collection tank 506 and the filter 532 or 534 can be treated with the Kimchi lactic acid bacteria culture. Since the dirt such as food leftovers is filtered in the water collection tank 506, if the water collection tank 506 is not often cleaned, the remaining food leftovers give cut a bad smell and propagate bacteria. Accordingly, the first aspect of the present invention treats the water collection tank 506 with the filter 532 or 534 with the Kimchi lactic acid bacteria culture.

The method of performing the Kimchi lactic acid bacteria culture treatment will later be described in detail.

The second aspect of the present invention (FIG. 15) treats the detergent container 507 with the Kimchi lactic acid bacteria culture. The Kimchi lactic acid bacteria culture treatment can be carried mat by coating the Kimchi lactic acid bacteria culture on the detergent container 507, molding the detergent container 507 with a material containing the Kimchi lactic acid bacteria culture, or installing a container 540 for containing the liquid or powder phase Kimchi lactic acid bacteria culture to put the Kimchi lactic acid bacteria culture into wash water with the detergent, as shown in FIG. 16. As a result, the detergent container 517 contaminatable with moisture and food leftovers can have the antibacterial property. Furthermore, the wash tub 504, the water collection tank 506 and the wash water passages can be provided with the antibacterial property during the dishwashing process, by putting the Kimchi lactic acid bacteria culture into wash water.

The third aspect of the present invention treats the wash tub 504 with the Kimchi lactic acid bacteria culture. The Kimchi lactic acid bacteria culture treatment can be carried cut by coating the Kimchi lactic acid bacteria culture on the wash tub 504, or molding the wash tub 504 with a material containing the Kimchi lactic acid bacteria culture. Accordingly, the dishwashing machine can be continuously provided with the antibacterial property, and protected from the food leftovers sticking to the wash tub 504 and causing contamination, by treating the wash tub 504 with the Kimchi lactic acid bacteria culture.

The fourth aspect of the present invention treats the exhaust passage being connected from the exhaust hole **503*h* to the main body 502 and communicating with the external space with the Kimchi lactic acid bacteria culture. The Kimchi lactic acid bacteria culture treatment can be carried out by coating the Kimchi lactic acid bacteria culture on the exhaust passage, molding the exhaust passage with a material containing the Kimchi lactic acid bacteria culture, or installing a filter containing the Kimchi lactic acid bacteria culture in the exhaust passage. In addition, the Kimchi lactic acid bacteria culture treatment can be performed by treating the exhaust hole 503*h* or the ventilation fan formed on the exhaust passage with the Kimchi lactic acid bacteria culture. The exhaust passage exhausts the mist from the wash tub 504** to the kitchen in the drying. The mist is treated with the Kimchi lactic acid bacteria culture through the exhaust passage to have the antibacterial property. Also, the exhaust passage can be protected from contamination.

The method of performing the Kimchi lactic acid bacteria culture treatment and the Kimchi lactic acid bacteria culture exposure treatment in accordance with the present invention will now be described in detail.

The Kimchi lactic acid bacteria culture fluids acquired through various routes can be used without special restrictions, so far as they have the antibacterial and antivirus effects. For example, the Kimchi lactic acid bacteria culture fluid can be directly extracted from Kimchi, extracted from the cultivated Kimchi lactic acid bacteria, or purchased in a market. Any publicly-known method can be used to cultivate and extract the Kimchi lactic acid bacteria without special restrictions.

In addition, any phases of Kimchi lactic acid bacteria culture fluids can be used without special restrictions, so far as they have the antibacterial and antivirus effects. For example, the Kimchi lactic acid bacteria culture fluid can be selected from the group consisting of the Kimchi lactic acid bacteria culture fluid itself, a concentrate of the Kimchi lactic acid bacteria culture fluid, a dry matter of the Kimchi lactic acid bacteria culture fluid, and mixtures thereof. Any publicly-known method can be used to concentrate and dry the Kimchi lactic acid bacteria culture fluid without special restrictions.

Preferably, the Kimchi, lactic acid bacteria are selected from the group consisting of *Leuconostoc* sp; Kimchi lactic acid bacteria, *Lactobacillus* sp. Kimchi lactic acid bacteria, *Weissella* sp. Kimchi lactic acid bacteria, and mixtures thereof.

Preferably, the *Leuconostoc* sp. Kimchi lactic acid bacteria are selected from the group consisting of *Leuconostoc citreum, Leuconostoc lactis, Leuconostoc mesenteroides* subsp. *dextranicum, Leuconostoc mesenteroides* subsp. *mesenteroides, Leuconostoc argentinum, Leuconostoc carnosum, Leuconostoc gellidum, Leuconostoc kimchii, Leuconostoc inhae, Leuconostoc gasicomitatum*, and mixtures thereof. More preferably, the *Leuconostoc* sp. Kimchi lactic acid bacteria are selected from the group consisting of *Leuconostoc citreum, Leuconostoc kimchii, Leuconostoc mesenteroides*, and mixtures thereof.

Preferably, the *Lactobacillus* sp. Kimchi lactic acid bacteria are selected from the group consisting of *Lactobacillus brevis, Lactobacillus acidophilus, Lactobacillus bulgaricus, Lactobacillus plantarum Lactobacillus kimchii, Lactobacillus paraplantarum, Lactobacillus curvatus* subsp. *curvatus, Lactobacillus sakei* subsp. *sakei*, and mixtures thereof.

Preferably, the *Weissella* sp. Kimchi lactic acid bacteria are selected from the group consisting of *Weissella koreensi, Weissella hanii, Weissella kimchii, Weissella soli, Weissella confusa*, and mixtures thereof.

A. Method of Coating the Kimchi Lactic Acid Bacteria Culture

The method of coating the Kimchi lactic acid bacteria culture coats the Kimchi lactic acid bacteria culture on a surface of an article. In accordance with the present invention, the Kimchi lactic acid bacteria culture can be coated singly or in combination with a binder and/or nano metal particles.

The article is one of various articles which bacteria, viruses, etc. may contact to propagate themselves. For example, thermoplastic resin, thermosetting resin, rubber and metal can be used as the raw materials. The raw materials can be used in various ways according to their characteristics. The article can be a filter. Any article performing the filtering function can be used without special restrictions in use, kind and type. Exemplary articles include an air filter, a water filter and a cleaner filter. Any kinds of materials having the filtering function can be used as a material of the filter without special restrictions in kind, type, size and manufacturing process. Exemplary materials include a glass fiber, an ion exchange fiber, a cellulose fiber and an asbestos fiber, various organic and inorganic fibers, a metal such as zinc, copper and aluminum, and a plastic. Such materials can be variously used depending on their characteristics. The type of the filter can be appropriately modified depending on an apparatus using the filter without special restrictions, such as honeycomb type, grain type, net type, filter paper type, cotton type, mesh type, plate type and foam type. In accordance with the present invention, the filter can be used singly or in combination with the existing filter in the same product. Also, the article can be an air filter. Any article performing the air filtering function can be used as the air filter without special restrictions in kind, type, size and manufacturing process. Also, the type of the air filter can be appropriately modified depending on an apparatus using the filter without special restrictions. In accordance with the present invention, the air filter can replace a deodorization filter such as an activated charcoal filter, an aluminum mesh filter, a carbon filter, and a HEPA filter which are used in various electric home appliances such as a refrigerator, an air conditioner and an air freshener, and a filter of an air purifier of a vehicle, or can be used in combination with the existing filters.

In accordance with the present invention, the Kimchi lactic acid bacteria can be used with a binder. Silicone modified acryl resin, urethane resin, acryl resin and silicone resin can be used as the binder, which is not intended to be limiting. That is, various kinds of binders can be employed. In the case that the Kimchi lactic acid bacteria are not singly used but used with the binder, the binder serves to easily fix the Kimchi lactic acid bacteria to the surface of the article, and improve the inter-coupling action between the surface of the article needing the antimicrobial property and the Kimchi lactic acid bacteria. As a result, the binder reduces the elution rate of the Kimchi lactic acid bacteria, and maintains the antimicrobial performance.

In accordance with the present invention, any kinds of metal particles having a sterilizing function can be used as the nano metal particles without special restrictions. Exemplary metal particles include Ag, Zn, Cu, Pt, Cd, Pd, Rh and Cr particles. The metal particles can be singly or mixedly used. The nano metal particles mean metal particles made in a nano size. Any kinds of metal particles made in a nano size can be used without special restrictions in manufacturing process. The nano metal particles prevent propagation of microorganisms such as bacteria, fungi, etc, by restricting the reproduction function of the microorganisms, and interrupt the metabolism of the microorganisms by infiltrating into cells and stopping the enzyme function required in respiration, thereby performing sterilization. In the viewpoint of the antibacterial property and harmlessness to the environment and human body, the nano metal particles are preferably Ag, Zn and Cu nano metal particles, more preferably, nano Ag. Especially, the nano Ag can improve the efficiency of the Kimchi lactic acid bacteria culture fluid.

In accordance with one aspect of the present invention, the Kimchi lactic acid bacteria culture fluid can be singly coated on the surface of the article, for giving the antimicrobial property. In accordance with another aspect of the present invention, both the Kimchi lactic acid bacteria culture fluid and the nano metal particles can be coated on the surface of the article, for giving the antimicrobial property. Expected is the synergy of the Kimchi lactic acid bacteria culture fluid with the antibacterial and antivirus effects and the nano metal particles with the antibacterial function. According to the characteristic of the article, the characteristic of the manufacturing process, and the necessity of the antimicrobial property, the Kimchi lactic acid bacteria culture fluid can be used singly or in combination with the nano metal particles. Preferably, 5 to 20 wt % of Kimchi lactic acid bacteria culture fluid and 100 to 2000 ppm of nano metal particles are coated on the surface of the article. This range semipermanently gives the antimicrobial property to the surface of the article in consideration of the antibacterial and antivirus effects over 99%, the coating characteristic and the mixing characteristic. However, if necessary, it can be appropriately adjusted.

The step for coating the surface of the article with the Kimchi lactic acid bacteria culture fluid, or the Kimchi lactic acid bacteria culture fluid and the nano metal particles can be performed according to a general method in the field to which the present invention pertains. Any kinds of methods which can evenly coat the surface of the article can be used.

When the Kimchi lactic acid bacteria culture fluid is singly coated, the Kimchi lactic acid bacteria culture fluid can be coated directly on the surface of the article. An appropriate fixation technique can be chemically or mechanically used to fix the Kimchi lactic acid bacteria culture fluid to the surface of the article. In addition, a method of preparing a coating solution containing the Kimchi lactic acid bacteria culture fluid, and spraying the coating solution to the surface of the article or dipping the article in the coating solution can be used to coat the surface of the article. The coating solution can be water or ethanol, which is not intended to be limiting. Any solution containing the Kimchi lactic acid bacteria culture fluid at an appropriate amount and giving the antimicrobial property to the surface of the article by coating can be used as the coating solution without special restrictions in kind and manufacturing process. The publicly-known spraying method such as air spray can be used, which is not intended to be limiting. Any kinds of methods which can evenly coat the surface of the article can be employed. In addition, the general dipping method can be used without special restrictions. Preferably, the amount of the Kimchi lactic acid bacteria culture fluid ranges from 5 to 20 wt %, which is not intended to be limiting. If necessary, the amount of the Kimchi lactic acid bacteria culture fluid can be appropriately adjusted.

Alternatively, in the case that the Kimchi lactic acid bacteria culture fluid and the nano metal particles are coated together, the Kimchi lactic acid bacteria culture fluid and the nano metal particles can be sequentially coated on the surface of the target article. According to the sequential coating process, the nano metal particles is coated on the surface of the article, and then the Kimchi lactic acid bacteria culture fluid is coated on the surface of the article coated with the nano metal particles. The step for coating the nano metal particles on the surface of the article can be performed according to a method publicly known in this field. If necessary, the nano metal particles can be modified for easy coating depending on the characteristic of the article. In addition, the step for coating the Kimchi lactic acid bacteria culture fluid on the surface of the article coated with the nano metal particles can be performed according to a method generally used in this field without special restrictions. A chemical or mechanical method can be appropriately used to fix the Kimchi lactic acid bacteria to the article coated with the nano metal particles. Any method of evenly coating the surface of the article, such as spraying and dipping can be used for coating. Conversely, it is possible to be coated with the Kimchi lactic acid bacteria culture fluid first, and coated with the nano metal particles on the surface of the article coated with the Kimchi lactic acid bacteria culture fluid. It is also possible to prepare a coating solution containing the Kimchi lactic acid bacteria culture fluid and the nano metal particles by mixing the two substances, and coat the coating solution on the surface of the article by spraying or dipping. Any method of preparing the coating solution can be employed without special restrictions, so far as the Kimchi lactic acid bacteria culture fluid and the nano metal particles can be coated on the surface of the article to give the antimicrobial property. Preferably, the amount of the Kimchi lactic acid bacteria culture fluid ranges from 5 to 20 wt %, and the content of the nano metal particles ranges from 100 to 2000 ppm. This range semipermanently gives the antimicrobial property to the surface of the article in consideration of the antibacterial and antivirus effects over 99%, the coating characteristic and the mixing characteristic. However, if necessary, this range can be appropriately adjusted.

Further, in accordance with the present invention, in the case that the Kimchi lactic acid bacteria culture fluid is coated on the surface of the article, the Kimchi lactic acid bacteria culture fluid can be mixed with the binder before the coating step. The binder improves the inter-coupling action between the surface of the article and the Kimchi lactic acid bacteria culture fluid, and reduces the elution rate of the Kimchi lactic acid bacteria culture fluid, thereby maintaining the antimicrobial performance. Accordingly, it is more advantageous to mix the Kimchi lactic acid bacteria culture fluid with the binder than to singly use the Kimchi lactic acid bacteria culture fluid. Any method of mixing the Kimchi lactic acid bacteria culture fluid with the binder can be used without special restrictions, so far as the Kimchi lactic acid bacteria culture fluid can be coated on the surface of the article. The content ratio of the Kimchi lactic acid bacteria culture fluid to the binder is not specially restricted but appropriately adjusted. If necessary, an inorganic pigment can be added.

In accordance with one embodiment of the present invention, the coating solution containing the Kimchi lactic acid bacteria culture fluid and the nano metal particles was prepared, and spray-coated on an aluminum mesh filter, thereby obtaining the filter with the antimicrobial property. In one experiment of the present invention, *Escherichia coli, Staphyllococcus aureus* and *Pseudomonas aeruginosa* were used to test the antibacterial activity of the filter with the antimicrobial property. As a result, the filter with the antimicrobial property showed excellent antibacterial activity to *Escherichia coli, Staphyllococcus aureus* and *Pseudomonas aeruginosa*. In another experiment of the present invention, H5N1, which was an avian influenza virus, was used to test the antivirus activity of the filter. As a result, the filter showed a high virus reduction rate.

On the other hand, the manufacturing method can further include a step for washing the target article with proper wash water, and a step for drying the article by a thermal treatment after the washing, prior to coating the Kimchi lactic acid bacteria culture fluid on the surface of the article. In addition, the manufacturing method can further include a step for drying the article naturally or by a thermal treatment after coating the Kimchi lactic acid bacteria culture fluid on the surface of the article. The thermal treatment serves to fix the Kimchi lactic acid bacteria culture fluid and the nano metal particles to the surface of the article. A drying time and a drying temperature of the article are adjustable according to the shape, kind and size of the article. In case the target article is made of metal, it is advantageous to remove oil elements sticking to the surface of the article in the manufacturing or keeping process.

In accordance with the present invention, if necessary, the manufactured article can be post-processed into a wanted shape and appropriately used. Especially, the air filter can be cut into a wanted size and used as a filter of an air purifier. The a filter can be used singly or in combination with the existing air filter and deodorization filter in the same product. The air filter can be applied to various air purifiers for home or business use, refrigerators, vehicles, and other electric home appliances.

APPLICATION EXAMPLES

1) Application to Washing Machine

The surfaces of the components of the washing machine such as an inner tub, an cuter tub, a pulsator, a detergent box, a drum lift and a tub can be coated. In addition, the present invention can be applied to filters (air filter and water filter) in a dry passage, a water supply/drain passage, and a circulation passage.

2) Application to Dishwashing Machine

The present invention can be applied to a tub, a sump, a screen, a spray arm, a water filter, etc.

B. Method of Molding Kimchi Lactic Acid Bacteria Culture

Molding of the Kimchi lactic acid bacteria culture is carried cut by manufacturing a molded article by using the Kimchi lactic acid bacteria culture singly or in combination with the nano metal particles.

In accordance with the present invention, the article can be molded by combining the Kimchi lactic acid bacteria culture fluid or both the Kimchi lactic acid bacteria culture fluid and the nano metal particles with a raw material. Any kinds of raw materials which can form the shape of the article, preferably, the whole electric home appliance or the parts thereof can be used without special restrictions. For example, thermoplastic resin, thermosetting resin, rubber and metal can be used as the raw materials. The raw materials can be used in various ways according to their characteristics. Exemplary raw materials include polymers such as silicone, polyurethane, polyethylene, polypropylene (PP), polyvinylchloride (PVC), latex, acrylonitrile butadiene styrene (ABS), polytetrafluoroethylene (PTFE), polycarbonate (PC) and polyvinylalcohol (PVA). The raw materials can be singly or mixedly used.

In accordance with the present invention, the Kimchi lactic acid bacteria culture fluid or both the Kimchi lactic acid bacteria culture fluid and the nano metal particles are not uniformly distributed but distributed with a different content ratio in the molded article. For this, the article can be manufactured with the portion containing the Kimchi lactic acid bacteria culture fluid or both the Kimchi lactic acid bacteria culture fluid and the nano metal particles, and the portion containing the Kimchi lactic acid bacteria culture fluid or both the Kimchi lactic acid bacteria culture fluid and the nano metal particles in a lower or no content, by additionally performing an appropriate operation publicly known in this field in the molding step. In general, bacteria or viruses may contact to proliferate highly in the portion of the article that directly meets a medium such as the air and water in which bacteria and viruses are floating. Thus, it is such a portion of the article that needs the antimicrobial property. For this, it is necessary to intensively treat the portion of the article requiring the antimicrobial property with the Kimchi lactic acid bacteria culture fluid. As a result, the same amount of Kimchi lactic acid bacteria culture fluid can improve the substantial antimicrobial effect. For example, the molded article with the antimicrobial property can be manufactured by extrusion or injection-molding one layer by combining the Kimchi lactic acid bacteria culture fluid or the Kimchi lactic acid bacteria culture fluid and the nano metal particles with the raw material, extrusion or injection-molding another layer by combining the Kimchi lactic acid bacteria culture fluid or the Kimchi lactic acid bacteria culture fluid and the nano metal particles with the raw material in a lower content, and jointing the molded layers. In addition, the molded article with the antimicrobial property can be manufactured by extrusion or injection-molding one layer by combining the Kimchi lactic acid bacteria culture fluid or the Kimchi lactic acid bacteria culture fluid and the nano metal particles with the raw material, extrusion or injection-molding another layer by using the raw material without adding the Kimchi lactic acid bacteria culture fluid or the nano metal particles, and jointing the molded layers. To distribute the Kimchi lactic acid bacteria culture fluid in a different content in a single layer instead of jointing layers, the molded article with the antimicrobial property can be manufactured by combining the Kimchi lactic acid bacteria culture fluid or the Kimchi lactic acid bacteria culture fluid and the nano metal particles with the raw material (raw material 1), combining the Kimchi lactic acid bacteria culture fluid or the Kimchi lactic acid bacteria culture fluid and the nano metal particles with the raw material in a lower content (raw material 2), and individually implanting the raw materials 1 and 2 by performing an appropriate operation in the extrusion or injection molding. Generally, bacteria or viruses may contact to proliferate highly in the portion of the article that directly meets a medium such as the air and water in which bacteria and viruses are floating. Thus, it is such a portion of the article that needs the antimicrobial property. For this, it is necessary to intensively treat the portion of the article requiring the antimicrobial property with the Kimchi lactic acid bacteria culture fluid by diversifying the content of the Kimchi lactic acid bacteria culture fluid, instead of uniformly combining the Kimchi lactic acid bacteria culture fluid with the raw material and evenly distributing the Kimchi lactic acid bacteria culture fluid on the whole article in the molding. As a result, the same amount of Kimchi lactic acid bacteria culture fluid can improve the substantial antimicrobial effect.

The step for molding the article by combining the Kimchi lactic acid bacteria culture fluid or the Kimchi lactic acid bacteria culture fluid and the nano metal particles with the raw material can be carried cut according to a method generally used in this field. Any method which can form the shape of the article can be used without special restrictions. Exemplary molding methods include extrusion molding and injection molding. Since the Kimchi lactic acid bacteria culture fluid is combined with the raw material in the molding step of the article, the manufacturing time is reduced and the manufacturing process is simplified.

When the Kimchi lactic acid bacteria culture fluid is singly combined with the raw material, any combination method which can form the shape of the article can be used without special restrictions. The combination ratio of the Kimchi lactic acid bacteria culture fluid to the raw material is not specially restricted but appropriately adjusted. Preferably, the amount of the Kimchi lactic acid bacteria culture fluid ranges from 5 to 20 wt %, which is not intended to be limiting. If necessary, such a range can be appropriately adjusted.

Alternatively, when the Kimchi lactic acid bacteria culture fluid and the nano metal particles are combined with the raw material, any combination method which can form the shape of the article can be used without special restrictions. The combination ratio thereof is not specially restricted but appropriately adjusted. Preferably, the amount of the Kimchi lactic acid bacteria culture fluid ranges from 5 to 20 wt %, and the content of the nano metal particles ranges from 100 to 2000 ppm to improve the antimicrobial performance, combination characteristic and molding characteristic. However, if necessary, such ranges are appropriately adjustable.

In addition, the Kimchi lactic acid bacteria culture fluid can be encapsulated before the combination with the raw material, and then combined with the raw material. The encapsulation of the Kimchi lactic acid bacteria culture fluid prevents the Kimchi lactic acid bacteria culture fluid from being degenerated at a high temperature in the molding step of the article. Accordingly, the article can be molded at a relatively high temperature. The capsule consists of a core material and a wall material. The core material includes an objective material such as an antibacterial agent, a deodorant agent and an aromatic agent, and the wall material includes micro or nano size grains by forming a thin film with synthetic or natural polymers. Any material which can contain the Kimchi lactic acid bacteria culture fluid can be used as the wall material without special restrictions. Exemplary wall materials include melamine, polyurethane, gelatin, acryl, epoxy, starch, alginate, Chitosan, and mixtures thereof. The encapsulation can be performed according to a method generally used in this field without special restrictions. Once the Kimchi lactic acid bacteria culture fluid is encapsulated, the Kimchi lactic acid bacteria culture fluid is not degenerated at a high molding temperature of the article. The wall material of the capsule is dissolved or burst at a predetermined time after the molding to spread the Kimchi lactic acid bacteria culture fluid on the whole article. As a result, the antimicrobial effect can be more improved. The encapsulation of the Kimchi lactic acid bacteria culture fluid can be performed according to a method generally used in this field without special restrictions. The molding temperature is not specially restricted but appropriately adjusted according to the characteristic of the raw material of the article. In consideration of the degeneration of the Kimchi lactic acid bacteria culture fluid, preferably, the molding temperature ranges from 100 to 180° C. In the case that the Kimchi lactic acid bacteria culture fluid is encapsulated, degeneration possibility due to the temperature is lowered. As a result, the molding temperature can be raised, for example, to 100 to 250° C.

On the other hand, the manufacturing method can include additional processing steps, such as a drying step and a hardening step after combining the Kimchi lactic acid bacteria culture fluid with the raw material and molding the article. When the article is dried, a drying time and a drying temperature can be adjusted according to the shape, kind and size of the article. If necessary, the molded article can be post-processed into a wanted shape and appropriately used.

APPLICATION EXAMPLES

1) Application to Washing Machine and Drying Machine

The components of the washing machine such as an inner tub, an cuter tub, a pulsator, a detergent box, a drum lift and a tub can be molded by combining the Kimchi lactic acid bacteria culture fluid with the raw material. In addition, the present invention can be applied to filters in a dry passage, a water supply/drain passage, and a circulation passage.

2) Application to Dishwashing Machine

The present invention can be applied to a tub, a sump, a screen, a spray arm, a water filter, etc.

The present invention will now be explained by the following examples. Such examples are not intended to be limiting.

EXAMPLE 1

An aluminum mesh made by Airphil corporation was immersed into 2.5% NaOH solution for about 3 minutes, to remove oil components. Then, the oil removed-aluminum mesh was washed with 2.5% NaOH solution. The washing step was repeated 7 times. A thermal treatment was performed on the washed aluminum mesh by drying in a dry oven at a temperature of 40° C. for 2 hours.

EXAMPLE 2

10 g of dry powder of culture fluid of *Leuconostoc citreum* selected from the *Leuconostoc* sp. Kimchi lactic acid bacteria was mixed with 15 g of silicone modified acryl resin binder, 3 g of nano zinc, 1 g of nano silver and 0.5 g of nano copper, and dissolved in a water as a solvent, thereby preparing a coating solution containing Kimchi lactic acid bacteria culture fluid. The coating solution was air-sprayed on the aluminum mesh prepared in Example 1 and then the coated aluminum mesh was dried. Obtained was an aluminum mesh filter sample coated with the Kimchi lactic acid bacteria culture fluid and the nano metal particles.

TEST EXAMPLE 1

Antibacterial Property Test

The antibacterial property of the aluminum mesh coated with the Kimchi lactic acid bacteria culture fluid in Example 2 was tested according to a shake flask method (KS M 0146-2003) by using *Escherichia coli* (ATCC 25922), *Staphylococcus aureus* (ATCC 6538) and *Pseudomonas aeruginosa* (ATCC 27853).

1 ml of *Escherichia coli* culture, *Staphylococcus aureus* culture and *Pseudomonas aeruginosa* culture were respectively coated on the aluminum mesh filter samples (1.0 cm×1.0 cm) prepared in Example 2, respectively. The aluminum mesh filter samples coated with each strain culture were immersed into a Erlenmeyer flask containing LB broth, and shake incubated at 35±1° C. in 120 rpm for 3 hours. For comparison, 1 ml of each strain culture was inoculated into a Erlenmeyer flask containing LB broth, and shake incubated in the same condition. The incubated cell cultures were taken up to spread on a LB plate, and incubated at 37° C. for 48 hours. The colonies of each bacteria were counted. The results are shown in the following Tables 1 to 3.

TABLE 1

| Strain | Sample | Initial (cfu/ml) | 1 hr (cfu/ml) | 2 hrs. (cfu/ml) | 3 hrs. (cfu/ml) | Suppression rate (%) |
|---|---|---|---|---|---|---|
| *E. coli* | Example 2 | $1.5 \times 10^5$ | <10 | <10 | <10 | >99.9 |
| | Comparison | $1.5 \times 10^5$ | $1.6 \times 10^5$ | $1.7 \times 10^5$ | $2.0 \times 10^5$ | |

*cfu/ml: colony formation unit per ml

TABLE 2

| Strain | Sample | Initial (cfu/ml) | 1 hr (cfu/ml) | 2 hrs. (cfu/ml) | 3 hrs. (cfu/ml) | Suppression rate (%) |
|---|---|---|---|---|---|---|
| *S. aureus* | Example 2 | $1.3 \times 10^5$ | <10 | <10 | <10 | >99.9 |
| | Comparison | $1.3 \times 10^5$ | $1.5 \times 10^5$ | $1.8 \times 10^5$ | $2.2 \times 10^5$ | |

*cfu/ml: colony formation unit per ml

TABLE 3

| Strain | Sample | Initial No. (cfu/ml) | 1 hr (cfu/ml) | 2 hrs. (cfu/ml) | 3 hrs. (cfu/ml) | Suppression rate (%) |
|---|---|---|---|---|---|---|
| *P. aeruginosa* | Example 2 | $1.2 \times 10^5$ | <10 | <10 | <10 | >99.9 |
| | Comparison | $1.2 \times 10^5$ | $1.4 \times 10^5$ | $1.7 \times 10^5$ | $2.2 \times 10^5$ | |

*cfu/ml: colony formation unit per ml

As known from the above Tables 1 to 3, as compared with the comparisons, the aluminum mesh filter coated with the Kimchi lactic acid bacteria culture fluid has excellent antibacterial activity to microorganisms, such as *Escherichia coli, Staphylococcus aureus* and *Pseudomonas aeruginosa.*

TEST EXAMPLE 2

Antivirus Properly Test

A coating solution containing Kimchi lactic acid bacteria culture fluid was prepared and sprayed on surfaces of an aluminum mesh filter, a carbon filter and a HEPA filter, respectively, thereby obtaining three kinds of filter samples coated with the Kimchi lactic acid bacteria culture fluid. The antivirus property test was performed on each filter.

Avian influenza virus H5N1 isolate was used to test the antivirus effect of the Kimchi lactic acid bacteria culture fluid. Mardin-Darby Canine Kidney (MDCK) cell lines from dog kidney cells were used as host cells of viruses.

First, 100 μl of MDCK cells ($5\times10^4$ cells/ml) were seeded onto each well of a 96-well plate, and incubated in 5% $CO_2$ incubator at 37° C. for 24 hours, so that the cells could cover the bottoms of the wells in a monolayer shape. A virus solution (1/10 v/v) diluted with PBS was added to each well containing the three kinds of samples (aluminum mesh filter, carbon filter and HEPA filter, respectively) coated with the Kimchi lactic acid bacteria culture fluid, and incubated at 37° C. For comparison, the virus solution was incubated in the same manner in regard to the same three samples which were not coated with the Kimchi lactic acid bacteria culture fluid. The weight of each sample was recorded before addition of the virus solution. A culture inoculated with the virus solution and a culture which was not inoculated with the virus solution were prepared for a positive comparison and a negative comparison to the viral cytopathic effect (vCPE), respectively.

In order to test the antivirus effect, the 10-times diluted culture for the aluminum filter sample coated with the Kimchi lactic acid bacteria culture fluid, the aluminum filter sample which was not coated with the Kimchi lactic acid bacteria culture fluid, and the positive comparison was inoculated into the seven rows of the 96-well plates in quadruple. And the culture for the negative comparison was inoculated into the final eighth row. After the inoculation, the plates were incubated in 5% $CO_2$ incubator at 37° C. for 3 days. The vCPE of the plate was observed, and the virus titer was determined as $TCID_{50}$ (50% tissue culture infective dose). The antivirus effect was represented by a virus reduction rate (%). Here, the virus reduction rate was a percentage value of $\log TCID_{50}$/ml converted by using a value obtained by subtracting the weight of the sample which was not coated with the Kimchi lactic acid bacteria culture fluid from the weight of the sample coated with the Kimchi lactic acid bacteria culture fluid. The results are shown in the following Tables 4 to 6.

TABLE 4

| | Virus titer ($TCID_{50}$/ml) | Coated Al mesh filter (g) | Non-coated Al mesh filter (g) | Virus reduction rate (%) |
|---|---|---|---|---|
| 30 minutes | 6.25 | 0.1132 | 0.0946 | 99.92 |
| 1 hour | 6.50 | 0.1091 | 0.0871 | >99.99 |
| 2 hours | 6.27 | 0.0999 | 0.0809 | >99.99 |
| 4 hours | 6.25 | 0.1195 | 0.0872 | >99.99 |
| 8 hours | 5.75 | 0.1175 | 0.0806 | 99.99 |

TABLE 5

| | Virus titer ($TCID_{50}$/ml) | Coated C filter (g) | Non-coated C filter (g) | Virus reduction rate (%) |
|---|---|---|---|---|
| 30 minutes | 6.75 | 0.3194 | 0.2720 | 99.90 |
| 1 hour | 6.50 | 0.3240 | 0.2743 | 99.84 |
| 2 hours | 6.00 | 0.3196 | 0.2635 | >99.99 |
| 4 hours | 5.75 | 0.4346 | 0.2887 | 99.82 |

TABLE 6

| | Virus titer ($TCID_{50}$/ml) | Coated HEPA filter (g) | Non-coated HEPA filter (g) | Virus reduction rate (%) |
|---|---|---|---|---|
| 30 minutes | 6.00 | 0.0820 | 0.0614 | 98.22 |
| 1 hour | 5.75 | 0.0848 | 0.0678 | 99.82 |
| 2 hours | 6.50 | 0.0545 | 0.0514 | 99.94 |
| 4 hours | 6.25 | 0.0560 | 0.0486 | 99.99 |
| 8 hours | 5.75 | 0.0529 | 0.0461 | 99.99 |

As known from the above Tables 4 to 6, the aluminum mesh filter, the carbon filter and the HEPA filter coated with the Kimchi lactic acid bacteria culture fluid have the virus reduction rate almost over 99%, namely, the excellent antivirus effect.

The invention claimed is:

1. An apparatus of supplying and discharging a fluid, comprising:

a cabinet having an inlet for inserting an object;

a door installed on the cabinet for opening and closing the inlet of the cabinet;

an inner tub;

a fluid inflow passage connected to the inner tub; and a fluid outflow passage connected to the inner tub, wherein at least one of the inner tub, the inflow passage, and the outflow passage is coated with a Kimchi lactic acid bacteria or is made with a material containing the Kimchi lactic acid bacteria culture for antibacterial and antivirus effects, and wherein the apparatus is one of a washing machine, a drying machine, and a dishwashing machine.

2. The apparatus of claim 1, further comprising a recirculation passage for circulating the fluid in the inner tub, wherein the recirculation passage is coated with a Kimchi lactic acid bacteria or is made with a material containing the Kimchi lactic acid bacteria culture.

3. The apparatus of claim 1, further comprising a steam passage for supplying steam to the inner tub, wherein the steam passage is coated with a Kimchi lactic acid bacteria or is made with a material containing the Kimchi lactic acid bacteria culture.

4. The apparatus of claim 1, further comprising a detergent box for supplying a detergent to the inner tub, wherein the detergent box is coated with a Kimchi lactic acid bacteria or is made with a material containing the Kimchi lactic acid bacteria culture.

5. The apparatus of claim 1, further comprising a filter at an inlet of the outflow passage, wherein the filter is coated with a Kimchi lactic acid bacteria or is made with a material containing the Kimchi lactic acid bacteria culture.

6. An apparatus of supplying and discharging a fluid, comprising:

a cabinet having an inlet for inserting an object;

a door installed on the cabinet for opening and closing the inlet of the cabinet;

an inner tub;

a fluid inflow passage connected to the inner tub;

a fluid outflow passage connected to the inner tub; and a filter provided at either the inflow passage connected to the inner tub or the fluid outflow passage connected to the inner tub, wherein the filter is made with a material containing a Kimchi lactic acid bacteria culture for antibacterial and antivirus effects, and wherein the apparatus is one of a washing machine, a drying machine, and a dishwashing machine.

7. An apparatus of supplying and discharging a fluid, comprising:

a cabinet having an inlet for inserting an object;

a door installed on the cabinet for opening and closing the inlet of the cabinet;

an inner tub;

a fluid inflow passage connected to the inner tub;

a fluid outflow passage connected to the inner tub; and a container containing a Kimchi lactic acid bacteria culture, wherein the Kimchi lactic acid bacteria culture is supplied to the inner tub through the inflow passage, and wherein the apparatus is one of a washing machine, a drying machine, and a dishwashing machine.

8. An apparatus of supplying and discharging a fluid, comprising:

a cabinet having an inlet for the laundry;

a door installed on the cabinet, for opening and closing the inlet of the cabinet;

a tub installed inside the cabinet and supplied with wash water;

a drum rotatably installed inside the tub, for washing the laundry;

a gasket installed between the inlet of the cabinet and the tub, for sealing up the gap between the door and the tub; and a lift installed on the inside surface of the drum, for mixing the laundry, wherein at least one of the door, tub, drum, gasket and lift is coated with a Kimchi lactic acid bacteria or is made with a material containing the Kimchi lactic acid bacteria culture for antibacterial and antivirus effects.

9. The apparatus of claim 8, further comprising:

a detergent box installed in the cabinet for containing a detergent, wherein the detergent box is coated with a Kimchi lactic acid bacteria or is made with a material containing the Kimchi lactic acid bacteria culture.

10. The apparatus of claim 8, further comprising:

a water supply hose and a water supply valve installed in the cabinet, for supplying wash water to the tub, wherein at least one of the water supply hose and the water supply valve is coated with a Kimchi lactic acid bacteria or is made with a material containing the Kimchi lactic acid bacteria culture.

11. The apparatus of claim 8, further comprising a drain hose and a drain pump installed in the cabinet, for draining wash water from the tub, wherein at least one of the drain hose and the drain pump is coated with a Kimchi lactic acid bacteria or is made with a material containing the Kimchi lactic acid bacteria culture.

12. An apparatus of supplying and discharging a fluid, comprising:

a cabinet having an inlet for the laundry;

a door installed on the cabinet, for opening and closing the inlet of the cabinet;

a tub installed inside the cabinet and supplied with wash water, a drum rotatably installed inside the tub, for washing the laundry;

a fluid outlet disposed to face the inside of the drum, for supplying a fluid exposed to a Kimchi lactic acid bacteria culture into the drum; and a container connected to the fluid outlet and containing the Kimchi lactic acid bacteria culture.

13. The apparatus of claim 12, further comprising a recirculation passage connected from the tub to the drum, for supplying wash water to the laundry in the drum by recirculating wash water, the wash water being exposed to the Kimchi lactic acid bacteria culture on the recirculation passage, wherein the fluid outlet is formed at the end of the recirculation passage.

14. The apparatus of claim 12, further comprising:

an operation button installed on the cabinet, for allowing the user to select an operation of supplying the Kimchi lactic acid bacteria culture of the container into the drum through the fluid outlet.

15. A method of operating an apparatus of supplying and discharging a fluid, which washes the laundry through a washing process including water supply, washing, drainage, rinsing and dehydration, by using a drum type washing machine comprising a tub supplied with wash water, and a drum rotatably installed in the tub for rotating the laundry, the method comprising a step for supplying a fluid exposed to a Kimchi lactic acid bacteria culture from a container containing the Kimchi lactic acid bacteria culture into the drum in the washing process.

16. The method of claim 15, wherein the washing process comprises a step for supplying wash water of the tub into the drum by recirculating wash water, and the fluid exposed to the Kimchi lactic acid bacteria culture is generated by exposing wash water to the Kimchi lactic acid bacteria culture in the step for recirculating and supplying wash water.

17. The method of claim 15, wherein the step for supplying the fluid exposed to the Kimchi lactic acid bacteria culture into the drum is carried cut in the rinsing.

18. An apparatus of supplying and discharging a fluid, comprising:

a cabinet having an inlet for the laundry;

a drum installed inside the cabinet and containing the laundry;

a steam passage installed in the cabinet for supplying steam into the drum, and composed of a water supply hose, a steam generator connected to the water supply hose, a steam outlet for supplying steam into the drum, and a steam supply hose for connecting the steam generator to the steam outlet; and a container disposed on the steam passage containing a Kimchi lactic acid bacteria culture, wherein the Kimchi lactic acid bacteria culture is supplied to the drum with the steam.

19. An apparatus of supplying and discharging a fluid, comprising:

a cabinet having an inlet for the laundry;

a drum installed inside the cabinet and containing the laundry;

a detergent box assembly being installed at one side of the cabinet, the detergent box assembly containing a detergent and a Kimchi lactic acid bacteria culture;

a steam generator being installed in the cabinet to supply steam into the drum, and communicating with the detergent box assembly; and a steam outlet connected from the steam generator to the drum, wherein the Kimchi lactic acid bacteria culture is supplied to the drum through the steam outlet with steam generated by the steam generator.

20. An apparatus of supplying and discharging a fluid, comprising:

a main body having its front surface opened, and including a wash tub for washing the dishes;

a door disposed on the front surface of the main body, for opening and closing the main body; and a water collection tank installed on the bottom surface of the wash tub, for collecting wash water, wherein at least one of the wash tub, the door and the water collection tank is coated with a Kimchi lactic acid bacteria or is made with a material containing the Kimchi lactic acid bacteria culture for antibacterial and antivirus effects.

21. The apparatus of claim 20, wherein the water collection tank comprises a filter for filtering off food leftovers, and the filter is coated with a Kimchi lactic acid bacteria or is made with a material containing the Kimchi lactic acid bacteria culture.

22. The apparatus of claim 20, wherein the door comprises a detergent container for dishwashing and the detergent container is coated with a Kimchi lactic acid bacteria or is made with a material containing the Kimchi lactic acid bacteria culture.

23. The apparatus of claim 20, further comprising an exhaust passage being connected from the wash tub to the main body and communicating with the outside of the main body, for exhausting mist of the wash tub to the outside of the main body to dry the dishes after dishwashing, wherein the exhaust passage is coated with a Kimchi lactic acid bacteria or is made with a material containing the Kimchi lactic acid bacteria culture.

* * * * *